US007635245B2

(12) United States Patent
Kaneko

(10) Patent No.: US 7,635,245 B2
(45) Date of Patent: Dec. 22, 2009

(54) TRANSPORTING RAIL UNIT AND CONNECTION MECHANISM IN LIBRARY APPARATUS

(75) Inventor: Hidetaka Kaneko, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 715 days.

(21) Appl. No.: 11/373,916

(22) Filed: Mar. 14, 2006

(65) Prior Publication Data

US 2007/0132344 A1 Jun. 14, 2007

(30) Foreign Application Priority Data

Dec. 13, 2005 (JP) ..... 2005-359086

(51) Int. Cl.
*B65G 1/00* (2006.01)
*B65G 65/00* (2006.01)

(52) U.S. Cl. ..... 414/280; 414/271; 414/285; 198/465.1; 198/465.2; 198/867.15; 104/172.1; 104/172.2; 104/172.3

(58) Field of Classification Search ..... 198/602, 198/465.1, 465.2, 867.14, 867.15; 414/271, 414/278, 280, 285; 104/254, 172.1, 172.2, 104/172.3; 312/9.2, 9.5
See application file for complete search history.

(56) References Cited

U.S. PATENT DOCUMENTS 593,605 A * 11/1897 Pearson ..... 104/254
3,967,718 A * 7/1976 Monahan ..... 198/783
4,461,379 A * 7/1984 Papp ..... 198/465.1
5,345,878 A * 9/1994 Jacob ..... 105/136
5,429,470 A * 7/1995 Nicol et al. ..... 414/331.05
6,070,534 A * 6/2000 Lehrieder ..... 104/172.3
6,123,028 A * 9/2000 Bellezza ..... 104/172.3
6,438,623 B1 * 8/2002 Ryan ..... 710/2
6,648,574 B2 * 11/2003 Williams ..... 414/277

FOREIGN PATENT DOCUMENTS

| | | |
|---|---|---|
| JP | 6-89445 | 3/1994 |
| JP | 8-273166 | 10/1996 |
| JP | 2002-197770 | 7/2002 |

* cited by examiner

*Primary Examiner*—Saúl J Rodríguez
*Assistant Examiner*—Jonathan D Snelting
(74) *Attorney, Agent, or Firm*—Staas & Halsey LLP

(57) ABSTRACT

A transporting rail unit includes a first driving mechanism driving the object to a first position on a rail. A second driving mechanism includes a member designed to displace in response to reception of a force from the object when the object moves forward to the first position from a second position in front of the first position on the rail. The second driving mechanism allows accumulation of an elastic repulsive force based on displacement of the member. The transporting rail unit allows the object to keep moving forward based on the elastic repulsive force even after the object is released from engagement with the first driving mechanism. If the second driving mechanism is interposed between the first driving mechanisms, the object can be transferred between the first driving mechanisms. A single transporting rail unit can be utilized in common. This results in reduction in the production and management costs.

4 Claims, 20 Drawing Sheets

TRANSPORTING RAIL UNIT AND CONNECTION MECHANISM IN LIBRARY APPARATUS

BACKGROUND OF THE INVENTION

1. Field of the Invention

The present invention relates to a transporting rail unit including a rail designed to guide the movement of an object and a driving mechanism generating a driving force for driving the object to a predetermined position on the rail. In particular, the present invention relates to a transporting rail unit preferably utilized in a transporting mechanism unit including a chain belt put on a pair of sprockets, a rail extending in parallel with the chain belt in a space between the sprockets, and a carriage guided on the rail for relative movement.

2. Description of the Prior Art

A so-called magnetic tape library apparatus is well known. The magnetic tape library apparatus includes a main cabinet containing magnetic tape drives and cell boxes. The cell box includes cells each capable of holding a magnetic tape cartridge. The magnetic tape cartridges are individually transported between the cell box and the magnetic tape drive. The magnetic tape drive is capable of recording magnetic information data in the magnetic tape cartridge, for example.

An extension cabinet can be coupled to the main cabinet. Cell boxes are likewise contained in the extension cabinet. A magnetic tape cartridge is transferred from the cell box in the extension cabinet to the magnetic tape drive in the main cabinet. A so-called pass-through mechanism, namely a transporting rail unit, is attached across the main cabinet and the extension cabinet. A carriage is allowed to reciprocate on the rail in the transporting rail unit between the main cabinet and the extension cabinet.

A conventional magnetic tape library apparatus requires different transporting rail units depending on the number of additional extension cabinets. Specifically, several kinds of transporting rail units having different lengths need to be prepared depending on the number of the additional extension cabinets. This results in an inevitable increase in the production cost and the management cost.

SUMMARY OF THE INVENTION

It is accordingly an object of the present invention to provide a transporting rail unit contributing to reduction in the production and management costs. It is also an object of the present invention to provide a transporting mechanism unit and a connection mechanism capable of significantly contributing to realization of the aforementioned transporting tail unit.

According to a first aspect of the present invention, there is provided a transporting rail unit comprising: a rail guiding movement of an object; a first driving mechanism generating a driving force for driving the object to a first position on the rail; and a second driving mechanism including a member designed to displace in response to reception of a force from the object when the object moves forward to the first position from a second position in front of the first position on the rail, the second driving mechanism allowing accumulation of an elastic repulsive force based on displacement of the member, the second driving mechanism generating a driving force acting on the object based on the elastic repulsive force when the object reaches the first position on the rail.

The transporting rail unit allows the object to keep moving forward based on the elastic repulsive force even after the object is released from engagement with the first driving mechanism. If the second driving mechanism is interposed between the first driving mechanisms, the object can be transferred between the first driving mechanisms. Accordingly, if the transporting rail units are coupled to each other, the object is allowed to move forward from a rail to another rail. Serial transporting rail units serve to provide a transporting mechanism having various lengths. It is not necessary to prepare several kinds of transporting mechanisms having different lengths. A single transporting rail unit can be utilized in common. This results in a sufficient contribution to reduction in the production cost and the management cost.

According to a second aspect of the present invention, there is provided a transporting rail unit comprising: a rail guiding movement of an object; and a pair of link mechanisms respectively having first and second arms coupled to each other through a connecting pin, the first and second arms taking first and second bending attitudes, the first bending attitude establishing a first angle between the first and second arms around the connecting pin, the second bending attitude establishing a second angle larger than the first angle between the first and second arms around the connecting pin, the link mechanism designed to oppose a joint between the first and second arms to a joint between the first and second arms in other of the link mechanisms, wherein the link mechanisms each comprises: a first elastic member exhibiting an elasticity sufficient to distance the first and second arms from each other through a swinging movement around the connecting pin from the first angle to the second angle; a shaft member coupling the first arm to the rail for relative rotation around a rotation axis set in parallel with an axis of the connecting pin at a location spaced from the connecting pin by a first distance; a contact member designed to establish a point of action for receiving a force from the object, the point of action being distanced from the connecting pin by a second distance larger than the first distance; a restricting piece holding the first arm at a specific angular position around the rotation axis when the force acts on the point of action from a first location, the first location set outside first and second imaginary planes, the first arm located inside the first imaginary plane including an axis of the connecting pin and the point of action, the first and second arms located inside the second imaginary plane including the rotation axis and the point of action; a second elastic member allowing accumulation of an elastic repulsive force based on the relative rotation of the first arm around the rotation axis from the specific angular position when the force acts on the point of action from a second location set outside the first imaginary plane and inside the second imaginary plane; and a lock member holding the first arm at the specific angular position around the rotation axis when the force acts on the point of action from a third location set outside the first imaginary plane and inside the second imaginary plane, wherein the transporting rail unit further comprises a controlling mechanism connected to the lock member, the controlling mechanism designed to allow release of the first arm from the lock member in one of the link mechanism while the lock member holds the first arm at the specific angular position in other of the link mechanism.

When the object moves from one of the link mechanisms to the other of the link mechanisms, the force of the object acts on the point of action from the first location set outside the first imaginary plane and outside the second imaginary plane in one of the link mechanism. The first arm is thus urged against the restricting piece around the rotation axis. The restricting piece serves to restrict the movement of the first arm around the rotation axis. The first and second arms thus bend around the connecting pin for establishment of the second bending attitude against the elasticity of the first elastic member. An elastic repulsive force is thus accumulated in the first elastic member.

When the object is interposed between the contact members of the link mechanisms, the object receives a driving force from one of the link mechanism based on the elastic repulsive force of the first elastic member. The other of the link mechanism receives a force at the point of action from the second location set outside the first imaginary plane and inside the second imaginary plane. When the lock member releases the first arm, the first arm rotates around the rotation axis from the specific angular position. The other of the link mechanism thus accepts the object. The object is in this manner transferred between the link mechanisms.

The link mechanisms enable transfer of the object between a pair of driving apparatuses. The driving apparatuses can be coupled with each other without any troubles. The link mechanisms greatly contribute to establishment of transporting mechanisms having various lengths depending on the number of the driving apparatuses. It is not necessary to prepare several kinds of transporting mechanisms having different lengths. A single transporting mechanism can be utilized in common. This results in a sufficient contribution to reduction in the production cost and the management cost. Here, the aforementioned contact member may comprise a roller designed to rotate around a rotation axis extending through the point of action in parallel with the connecting pin.

A specific connection mechanism may be provided for a transporting rail unit so as to realize the transporting rail unit, for example. The connection mechanism may comprise a pair of link mechanisms respectively having first and second arms coupled to each other through a connecting pin, the first and second arms taking first and second bending attitudes, the first bending attitude establishing a first angle between the first and second arms around the connecting pin, the second bending attitude establishing a second angle larger than the first angle between the first and second arms around the connecting pin, the link mechanism designed to oppose a joint between the first and second arms to a joint between the first and second arms in other of the link mechanisms. The link mechanisms each may comprise: a first elastic member exhibiting an elasticity sufficient to distance the first and second arms from each other through a swinging movement around the connecting pin from the first angle to the second angle; a shaft member coupling the first arm to the rail for relative rotation around a rotation axis set in parallel with an axis of the connecting pin at a location spaced from the connecting pin by a first distance; a contact member designed to establish a point of action for receiving a force from the object, the point of action being distanced from the connecting pin by a second distance larger than the first distance; a restricting piece holding the first arm at a specific angular position around the rotation axis when the force acts on the point of action from a first location, the first location set outside first and second imaginary planes, the first arm located inside the first imaginary plane including an axis of the connecting pin and the point of action, the first and second arms located inside the second imaginary plane including the rotation axis and the point of action; a second elastic member allowing accumulation of an elastic repulsive force based on the relative rotation of the first arm around the rotation axis from the specific angular position when the force acts on the point of action from a second location set outside the first imaginary plane and inside the second imaginary plane; and a lock member holding the first arm at the specific angular position around the rotation axis when the force acts on the point of action from a third location set outside the first imaginary plane and inside the second imaginary plane. A controlling mechanism may be connected to the lock member. The controlling mechanism is designed to allow release of the first arm from the lock member in one of the link mechanism while the lock member holds the first arm at the specific angular position in other of the link mechanism.

According to a third aspect of the present invention, there is provided a library apparatus comprising: a main cabinet including an enclosure containing a recording medium drive and a storage unit holding at least a recording medium; a first transporting unit incorporated in the main cabinet for transporting the recording medium between the recording medium drive and the storage unit; an extension cabinet related to the main cabinet, the extension cabinet including an enclosure containing a storage unit holding at least a recording medium; a second transporting unit incorporated in the extension cabinet for transporting the recording medium in the extension cabinet; a first rail attached to the main cabinet; a second rail attached to the extension cabinet, said second rail coupled to the first rail; a carriage guided along the first and second rails; a first driving apparatus coupled to the carriage on the first rail, said first driving apparatus directing the carriage to the first transporting unit at a first position on the first rail; and a second driving apparatus coupled to the carriage on the second rail, said second driving apparatus directing the carriage to the second transporting unit at a second position on the second rail.

The library apparatus utilizes a single carriage in common to the main cabinet and the extension cabinet. Moreover, the rail and the driving apparatus can be divided into units for the main cabinet and the extension cabinet. It is possible to separately manage the rail and the driving apparatus for the main cabinet and the extension cabinet. A single type of the rail and the driving apparatus can be utilized in common irrespective of the number of the extension cabinets. This results in a sufficient contribution to reduction in the production cost and the management cost.

According to a fourth aspect of the present invention, there is provided a transporting mechanism unit comprising: a pair of sprockets; a power source designed to drive at least one of the sprockets for rotation; a chain belt wound around the sprockets; a rail extending between the sprockets in parallel with the chain belt; a carriage guided along the rail for movement on the rail; a rack attached to the carriage for movement between a first position and a second position, the rack at the first position allowed to enter a movement path of the chain belt, the rack at the second position allowed to withdraw from the movement path of the chain belt; and an elastic member having an elasticity sufficient to urge the rack toward the first position.

The transporting mechanism unit allows the rack to get out of the movement path of the chain belt even when the rack collides against the chain belt in coupling the carriage with the chain belt. The elasticity of the elastic member then allows the rack to enter the movement path of the chain belt. The rack is in this manner reliably engaged with the chain belt.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
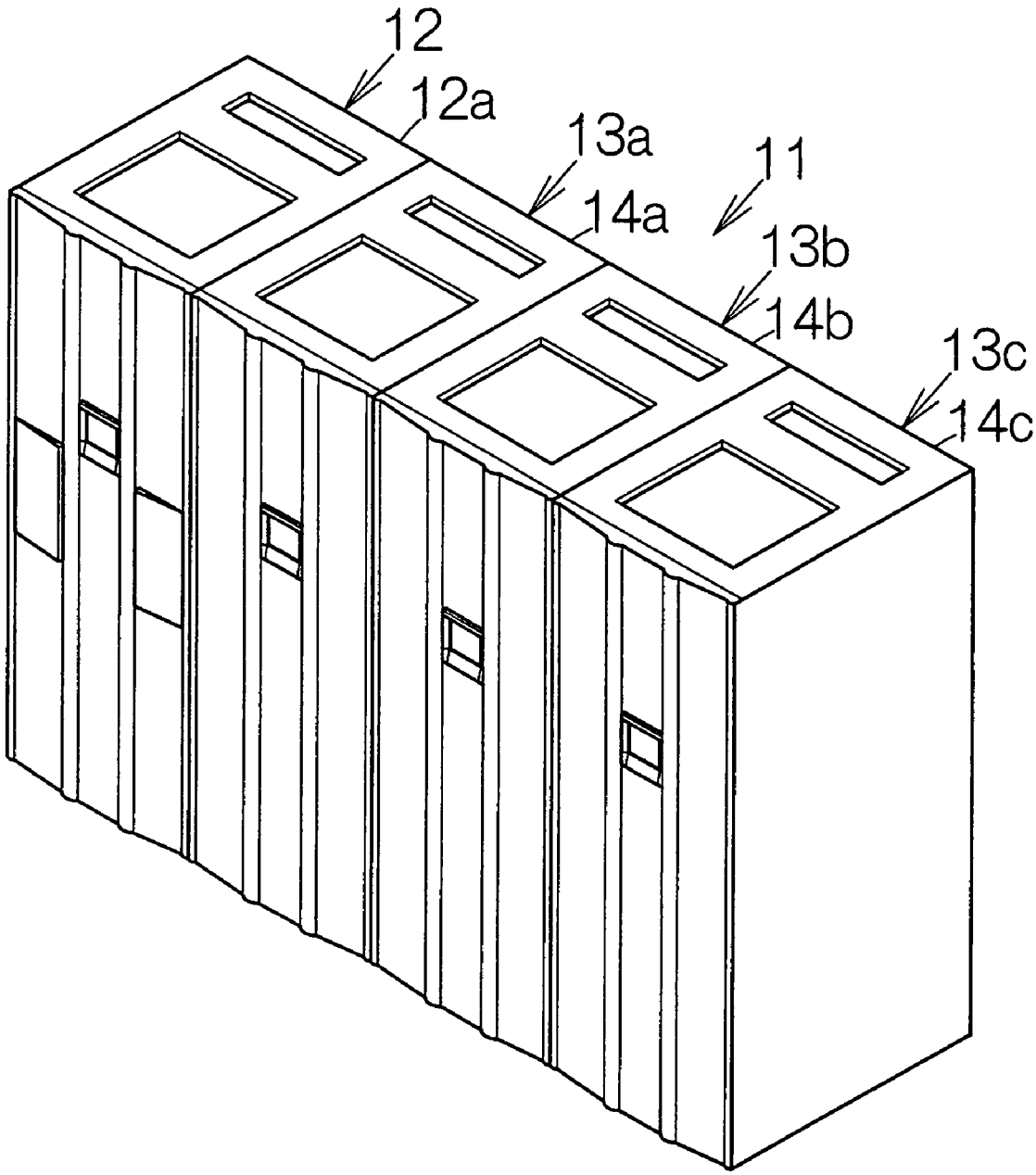
FIG. 1 is a perspective view schematically illustrating the appearance of a magnetic tape library apparatus.

FIG. 1 schematically illustrates the appearance of a magnetic tape library apparatus 11. The magnetic tape library apparatus 11 includes a main cabinet 12. The main cabinet 12 includes an enclosure 12*a* defining an inner space in the form of a parallelepiped standing upright from a floor, for example. One or more extension cabinets 13*a*, 13*b*, 13*c* are connected to the main cabinet 12. First, second and third extension cabinets 13*a*, 13*b*, 13*c* and so on are coupled to one another in this sequence from the first extension cabinet 13*a* adjacent to the main cabinet 12. The extension cabinets 13*a*, 13*b*, 13*c* likewise include enclosures 14*a*, 14*b*, 14*c*, respectively. The individual enclosures 14*a*, 14*b*, 14*c* define an inner space in the form of a parallelepiped standing upright from the floor, for example.

Figure 2:
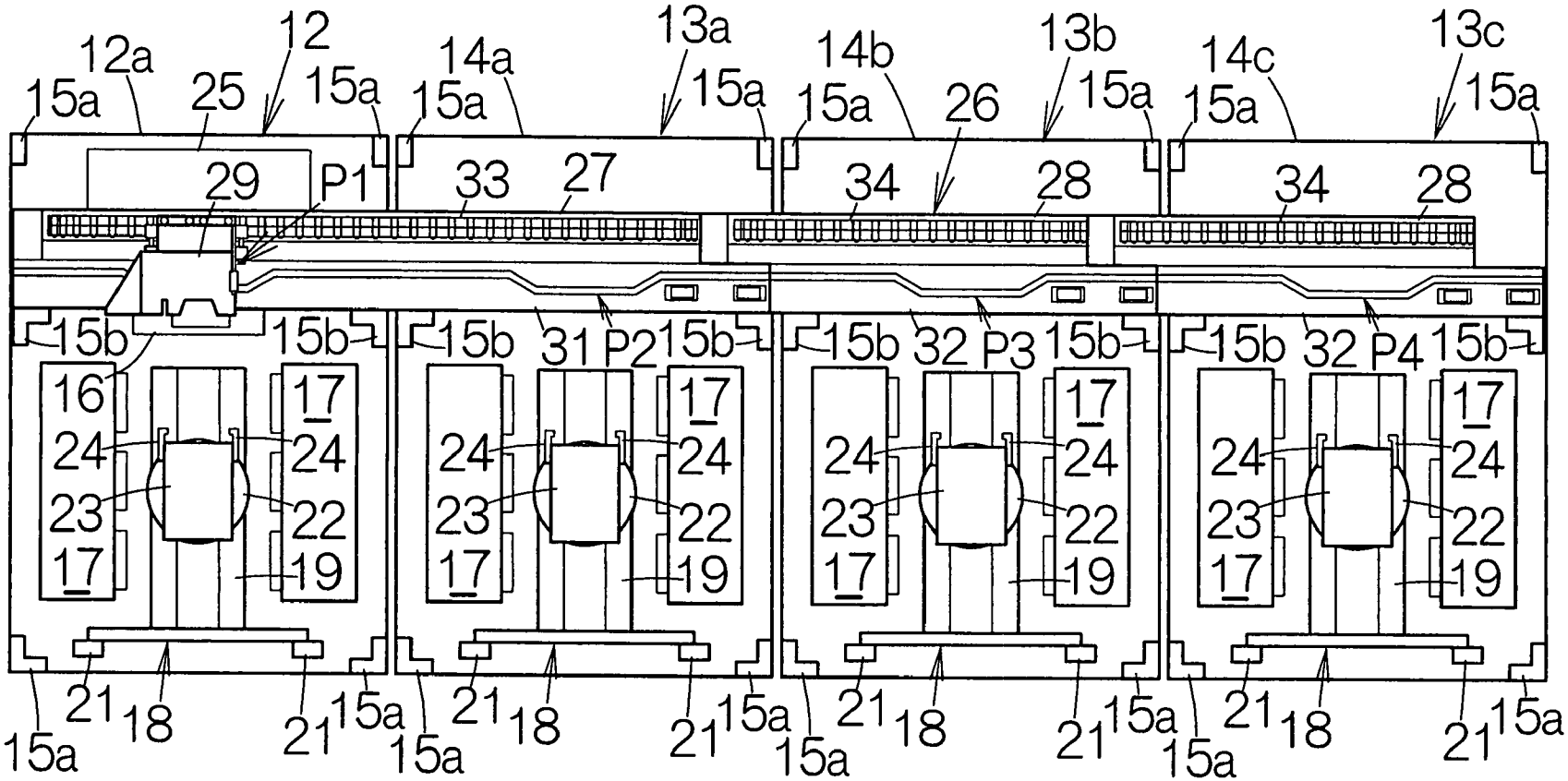
FIG. 2 is a plan view schematically illustrating the inner structure of a main cabinet and first to third extension cabinets.

As shown in FIG. 2, the individual enclosures 14*a*, 14*b*, 14*c* include support columns 15*a*, 15*b* establishing a frame. The support columns 15*a*, 15*b* stand upright from the floor. The frame is designed to support a front panel, a rear panel, side panels, and a top panel. These panels define the inner space of the individual enclosures 14*a*, 14*b*, 14*c*.

One or more recording medium drives or magnetic tape drives 16 are incorporated in the inner space of the enclosure 12*a* of the main cabinet 12. The magnetic tape drive is designed to receive insertion of a single one of the magnetic tape cartridges, for example. The magnetic tape drive 16 is designed to write magnetic information data into a magnetic tape inside the magnetic tap cartridge. The magnetic tape drive 16 is also designed to read magnetic information data out of the magnetic tape inside the magnetic tape cartridge. A backup server, not shown, supplies an instruction signal to the magnetic tape drive 16 for the write or read operation. The magnetic tape cartridge is inserted into and withdrawn from the magnetic tape drive 16 through the slot of the magnetic tape drive 16. The magnetic tape is unwound from a reel inside the magnetic tape cartridge in the magnetic tape drive 16. The unwound magnetic tape is then wound around a reel in the magnetic tape drive 16. A linear tape-open (LTO) cartridge may be employed as the magnetic tape cartridge, for example.

Cell boxes 17 are incorporated in the inner space of the enclosure 12*a*, for example. Two cell boxes 17, 17 are in this case opposed to each other at a certain distance. The individual cell boxes include cells. Each cell is capable of containing an object or a recording medium such as the magnetic tape cartridge, for example.

A transporting robot 18 is also incorporated in the inner space of the enclosure 12*a*. The transporting robot 18 includes a transporting rail 19 extending in the horizontal direction in parallel with the floor. The transporting rail 19 is coupled to a pair of support columns 21, 21 standing upright from the floor. The transporting rail 19 is designed to move in the vertical direction along the support columns 21. The transporting rail 19 is kept in the horizontal attitude during the vertical movement. The transporting rail 19 in this manner moves within a specific space. The individual magnetic tape drive 16 directs the slot to the specific space. The cell box 17 also directs the openings of the cells to the specific space.

A drive mechanism, not shown, is connected to the transporting rail 19 for the mentioned vertical movement. The drive mechanism may include a belt coupled to the transporting rail 19 at an end and a hoist winding up the belt, for example. A power source such as an electric motor is incorporated in the hoist, for example. A servomotor may be utilized as the electric motor, for example.

A mobile carrier 22 is mounted on the transporting rail 19. The mobile carrier 22 is allowed to move in the horizontal direction along the transporting rail 19. A drive mechanism, not shown, is connected to the mobile carrier 22 for the horizontal movement. The drive mechanism may include an endless belt wound around a pair of pulleys on the transporting rail 19, for example. The mobile carrier 22 may be connected to the belt. A power source may be utilized to control the rotation of one of the pulleys, for example. An electric motor may be employed as the power source. A servomotor may be utilized as the electric motor, for example.

A grasping mechanism or robot hand 23 is mounted on the mobile carrier 22 for relative rotation around a vertical axis. A drive mechanism, not shown, is connected to the robot hand 23 for the relative rotation. The drive mechanism may include an endless belt wound around the rotation axis of the robot hand 23 and a pulley mounted on the mobile carrier 22, for example. A power source may be utilized to control the rotation of the pulley, for example. An electric motor may be employed as the power source. A servomotor may be utilized as the electric motor, for example.

The robot hand 23 includes a pair of fingers 24, 24. The fingers 24, 24 are allowed to get opposed to the slot of the magnetic tape drive 16 or the opening of the cell through the vertical movement of the transporting rail 19, the horizontal movement of the mobile carrier 22 and the rotation of the robot hand 23. The fingers 24, 24 are designed to shift between a first position and a second position. The fingers 24, 24 are spaced from each other in the horizontal direction by a first distance when the fingers 24, 24 take the first position. The fingers 24, 24 are spaced from each other in the horizontal direction by a second distance smaller than the first distance when the fingers 24, 24 take the second position. The fingers 24, 24 at the first position define therebetween a space sufficient to receive the magnetic tape cartridge. The fingers 24, 24 at the second position are allowed to hold the magnetic tape cartridge therebetween. The magnetic tape cartridge is in this manner held in the grasping mechanism or the robot hand 23.

A drive mechanism, not shown, is connected to the fingers 24 for the movement between the first and second positions. A so-called rack-and-pinion mechanism may be employed as the drive mechanism, for example. A specific power source may be connected to the pinion of the rack-and-pinion mechanism. An electric motor may be employed as the power source. A servomotor may be utilized as the electric motor, for example.

The fingers 24 are also designed to move in the longitudinal direction along guiding rails, not shown, incorporated in the robot hand 23. A drive mechanism may be connected to the fingers 24, 24 for the longitudinal movement. A so-called rack-and-pinion mechanism may likewise be employed as the drive mechanism. When the fingers 24, 24 move forward in the longitudinal direction, the fingers 24, 24 is capable of grasp the magnetic tape cartridge at the slot of magnetic tape drive 16 or the opening of the cell. When the fingers 24, 24 move backward in the longitudinal direction, the magnetic tape cartridge can be taken into the robot hand 23 out of the magnetic tape drive 16 or the cell.

A controller 25 is further incorporated in the inner space of the enclosure 12*a*. The controller 25 is designed to control the vertical movement of the transporting rail 19, the horizontal movement of the mobile carrier 22, the rotation of the robot hand 23, and the movements of the fingers 24. The backup server supplies an instruction signal to the controller 25 for the mentioned control. The fingers 24 on the robot hand 23 are allowed to get opposed to the slot of the magnetic tape drive 16 or the opening of the cell through the control of the controller 25. The transporting robot 18 in this manner transport the magnetic tape cartridge between the magnetic tape drives 16 and the cells.

Cell boxes 17 are incorporated in the inner space of the individual enclosures 14*a*, 14*b*, 14*c* in the extension cabinets 13*a*, 13*b*, 13*c*. A transporting robot 18 is likewise incorporated in the inner space of the individual enclosures 14*a*, 14*b*, 14*c*. The cell boxes 17 and the transporting robot 18 may be identical to the aforementioned cell boxes 17 and the transporting robot 18 in the enclosure 12*a*. The magnetic tape drive 16 and the controller 25, however, are omitted in the inner space of the individual enclosures 14*a*, 14*b*, 14*c*.

A common transporting mechanism unit 26 is coupled to the main cabinet 12 and the first to third extension cabinets 13*a*-13*c*. The transporting mechanism unit 26 includes a first transporting rail unit 27 and second transporting rail units 28, 28. The first transporting rail unit 27 is attached to the main cabinet 12 and the first extension cabinet 13*a*. The second transporting rail units 28, 28 are attached to the second and third extension cabinets 13*b*, 13*c*, respectively. A single carriage 29 is in common mounted on the first and second transporting rail units 27, 28, 28. The first and second transporting rail units 27, 28, 28 enable movement of the carriage 29 between the main cabinet 12 and the first to third extension cabinets 13*a*-13*c*.

Figure 3:
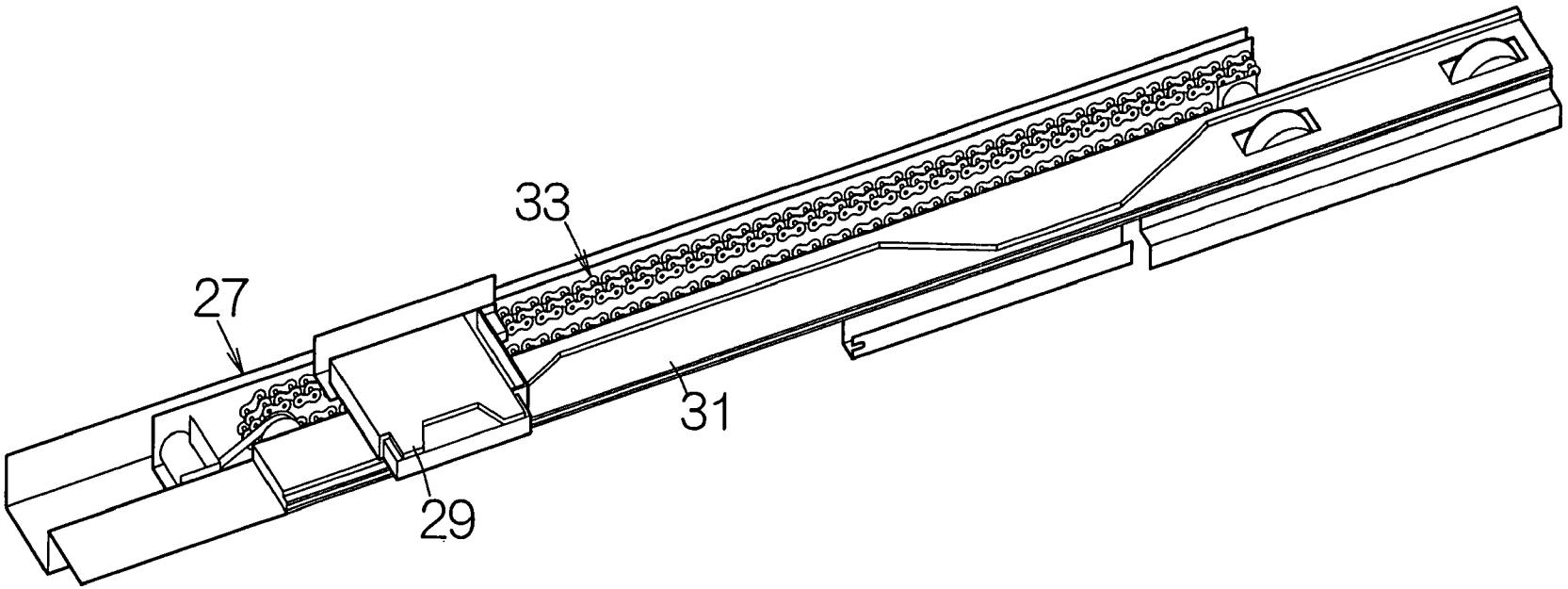
FIG. 3 is a perspective view schematically illustrating the appearance of a first transporting rail unit.

Referring also to FIG. 3, the first transporting rail unit 27 includes a first rail 31 attached to the support columns 15*b* of the main cabinet 12 and the first extension cabinet 13*a*. The first rail 31 is designed to guide the movement of the carriage 29. The second transporting rail units 28, 28 likewise include second rails 32, 32 attached to the support columns 15*b* of the second extension cabinet 13*b* and the third extension cabinet 13*c*, respectively. The second rails 32, 32 are designed to guide the movement of the carriage 29. The second rail 32 of the second extension cabinet 13*b* is connected to the first rail 31. The second rail 32 is set continuous with the first rail 31. The carriage 29 is thus allowed to move across the first and second rails 31, 32. The second rail 32 of the third extension cabinet 13*c* is connected to the second rail 32 of the second extension cabinet 13*b*. The second rails 32, 32 are set continuous with each other. The carriage 29 is thus allowed to move across the second rails 32, 32.

A first driving apparatus 33 is incorporated in the first transporting rail unit 27. The first driving apparatus 33 is coupled to the carriage 29 on the first rail 31. The first driving apparatus 33 is designed to drive the carriage 29 for movement along the first rail 31. When the carriage 29 is positioned at a first loading position P1 based on the action of the first driving apparatus 33, the carriage 29 can be opposed to the robot hand 23 of the transporting robot 18 within the main cabinet 12. Likewise, when the carriage 29 is positioned at a second loading position P2, the carriage 29 can be opposed to the robot hand 23 of the transporting robot 18 within the first extension cabinet 13*a*.

Second driving apparatuses 34, 34 are incorporated in the second transporting rail units 28, 28, respectively. The second driving apparatus 34 is coupled to the carriage 29 on the corresponding second rail 32. The second driving apparatus 34 is designed to drive the carriage 29 for movement along the corresponding second rail 32. When the carriage 29 is located at a third loading position P3 or a fourth loading position P4, the carriage 29 can be opposed to the robot hand 23 of the transporting robot 18 within the second extension cabinet 13*b* or the third extension cabinet 13*c*.

The magnetic tape library apparatus 11 enables recordation of magnetic information data in the individual magnetic tape cartridges. When magnetic information data is recorded in the magnetic tape cartridge, the magnetic tape cartridge is individually inserted into the magnetic tape drive 16. The transporting robot 18 of the main cabinet 12 transports the magnetic tape cartridge from the cell box 17 within the main cabinet 12 to the magnetic tape drive 16. When the magnetic information data has been recorded, the transporting robot 18 returns the magnetic tape cartridge to the cell box 17. Another one of the magnetic tape cartridges is then taken out of the cell box 17. This magnetic tape cartridge is inserted into the magnetic tape drive 16. Magnetic information data is recorded in the magnetic tape cartridge.

The transporting robot 18 individually takes the magnetic tape cartridge out of the cell of the cell box 17 in the first extension cabinet 13*a*. The carriage 29 is positioned at the second loading position P2 on the first rail 31. The magnetic tape cartridge is loaded on the carriage 29 from the robot hand 23 of the transporting robot 18 at the second loading position P2. The first driving apparatus 33 allows the carriage 29 to move from the second loading position P2 to the first loading position P1. The carriage 29 delivers the magnetic tape cartridge to the transporting robot 18 of the main cabinet 12 at the first loading position P1. The magnetic tape cartridge of the first extension cabinet 13*a* is in this manner transported to the magnetic tape drive 16. When the magnetic information data has been recorded, the transporting robot 18 loads the magnetic tape cartridge on the carriage 29 at the first loading position P1. The carriage 29 is then driven to move from the first loading position P1 to the second loading position P2. The transporting robot 18 returns the magnetic tape cartridge to the cell box 17 within the first extension cabinet 13*a*. Likewise, the magnetic tape cartridge can be exchanged between the carriage 29 at the third loading position P3 or the fourth loading position P4 and the corresponding transporting robot 18. Magnetic information data can thus be recorded in the magnetic tape cartridges of the second extension cabinet 13*b* and the third extension cabinet 13*c*.

Figure 4:
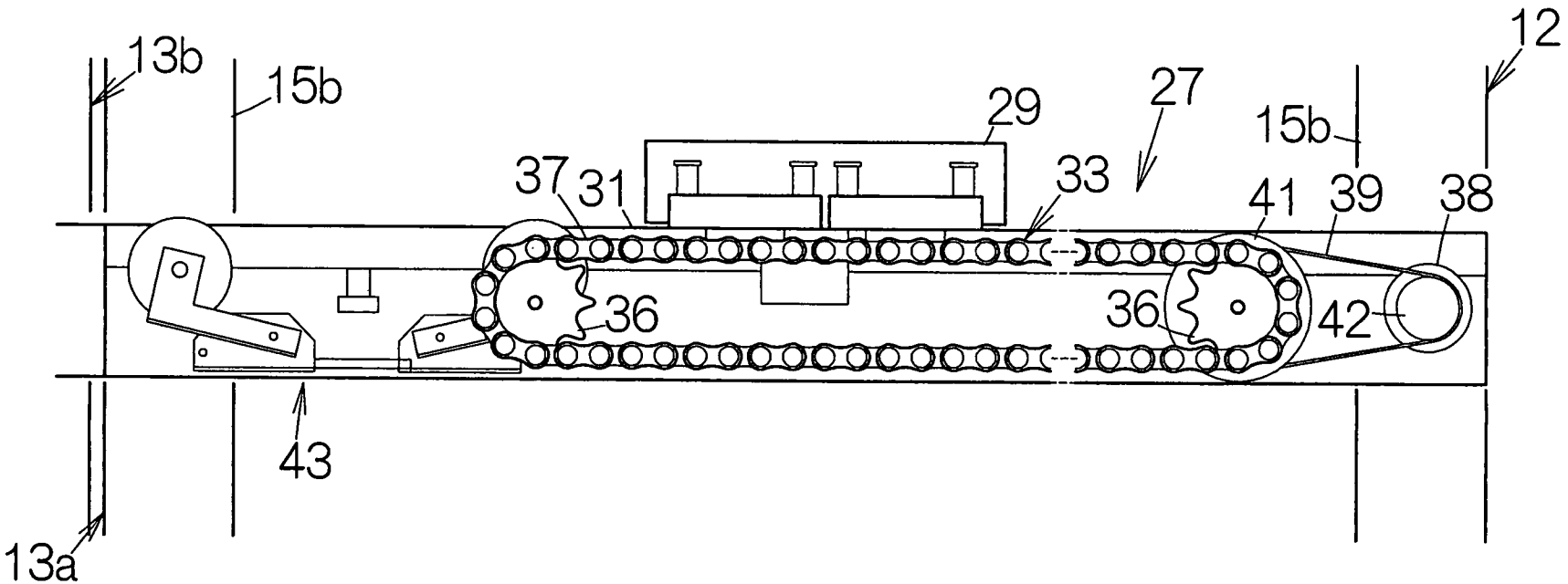
FIG. 4 is a side view of the first transporting rail unit for schematically illustrating the structure of a first driving apparatus.

A detailed description will be made on the structure of the first driving apparatus 33. As shown in FIG. 4, the first driving apparatus 33 includes a pair of sprockets 36, 36. The sprockets 36, 36 are spaced from each other in the horizontal direction. A chain belt 37 is wound around the sprockets 36, 36. A driving source or electric motor 38 is connected to one of the sprockets 36. A transmission belt 39 is wound around the rotation shaft of the sprocket 36 and the driving shaft of the electric motor 38. Pulleys 41, 42 may be fixed to the rotation shaft of the sprocket 36 and the driving shaft of the electric motor 38, respectively, so as to receive the transmission belt 39. The ratio between the diameters of the pulleys 41, 42 serves to determine the reduction ratio of the driving force transmitted to the sprocket 36 from the electric motor 38. When the sprocket 36 is driven to rotate, the chain belt 37 follows a straight path in parallel with the first rail 31 between the sprockets 36, 36. The second driving apparatuses 34 have structures identical to that of the first driving apparatus 33. The chain belt 37 follows a straight path in parallel with the second rail 32 between the sprockets 36, 36.

Figure 5:
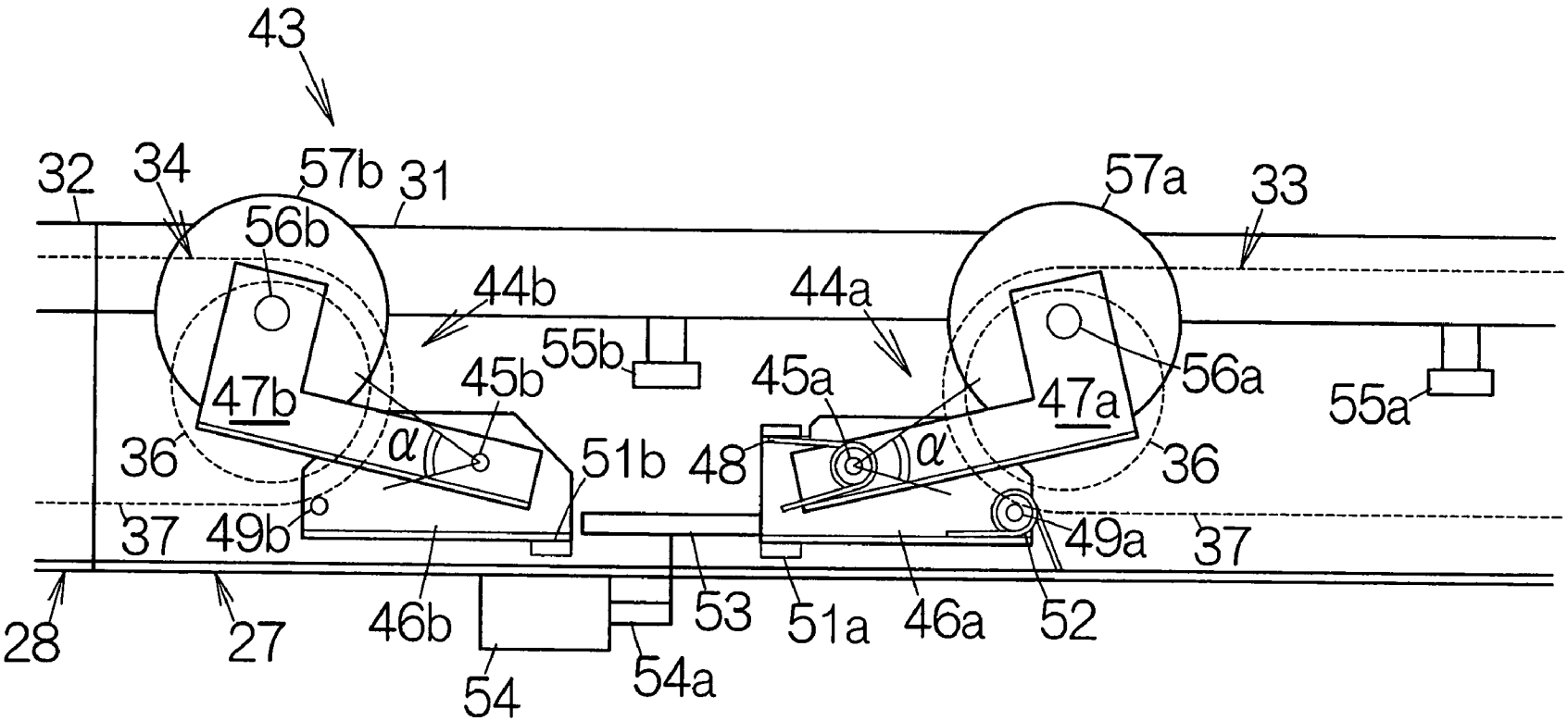
FIG. 5 is an enlarged side view schematically illustrating the structure of a connection mechanism for a transporting mechanism unit.

A connection mechanism 43 is incorporated in the first transporting rail unit 27. As shown in FIG. 5, the connection mechanism 43 is located below the first rail 31 at the end of the first rail 31 adjacent to the second rail 32. In other words, the connection mechanism 43 is located adjacent to a space defined between the first driving apparatus 33 and the second driving apparatus 34. The connection mechanism 43 serves to transport the carriage 29 between the first driving apparatus 33 and the second driving apparatus 34. The connection mechanism 43 thus realizes the movement of the carriage 29 across the boundary between the first transporting rail unit 27 and the second transporting rail unit 28.

Here, a detailed description will be made on the structure of the connection mechanism 43. The connection mechanism 43 includes a pair of link mechanisms 44*a*, 44*b*. The link mechanism 44*a* includes first and second arms 46*a*, 47*a* coupled to each other through a connecting pin 45*a*. The link mechanism 44*b* likewise includes first and second arms 46*b*, 47*b* coupled to each other through a connecting pin 45*b*. The first and second arms 46*a*, 47*a* or 46*b*, 47*b* bend through a relative rotation around the connecting pin 45*a* or 45*b*. When the first and second arms 46*a*, 47*a* or 46*b*, 47*b* are set at a first bending attitude, the bending angle $\alpha$ of a first angle is established around the connecting pin 45*a* or 45*b* between the first and second arms 46*a*, 47*a* or 46*b*, 47*b*. Likewise, when the first and second arms 46*a*, 47*a* or 46*b*, 47*b* are set at a second bending attitude, the bending angle $\alpha$ of a second angle is established around the connecting pin 45*a* or 45*b* between the first and second arms 46*a*, 47*a* or 46*b*, 47*b*. The second angle is set larger than the first angle. The link mechanism 44*a* allows the joint between the first and second arms 46*a*, 47*a* to get opposed to the joint between the first and second arms 46*b*, 47*b* of the link mechanism 44*b*. A first elastic member 48 such as a coil spring is interposed between the first and second arms 46*a*, 47*a* and 46*b*, 47*b*, respectively. The first elastic member 48 exhibits an elasticity sufficient to increase the bending angle $\alpha$ from the first angle to the second angle between the first and second arms 46*a*, 47*a* or 46*b*, 47*b* around the connecting pin 45*a* or 45*b*.

The first arms 46*a*, 46*b* are connected to the first rail 31 for relative rotation around support shafts 49*a*, 49*b*, respectively. The support shafts 49*a*, 49*b* are designed to extend in parallel with the connecting pins 45*a*, 45*b*. The support shaft 49*a* is spaced from the connecting pin 45*a* by a first distance. The support shaft 49*b* is likewise spaced from the connecting pin 45*b* by the first distance. The first rail 31 functions as a support member according to the present invention.

Restricting pieces 51*a*, 51*b* are related to the first arms 46*a*, 46*b*, respectively. The restricting pieces 51*a*, 51*b* may be fixed to the first rail 31, for example. The restricting piece 51*a* or 51*b* serves to restrict the swinging movement of the first arm 46*a* or 46*b* around the support shaft 49*a* or 49*b*. When the first arm 46*a* or 46*b* contacts with the restricting piece 51*a* or 51*b* through a relative rotation around the support shaft 49*a* or 49*b* in the normal direction, the first arm 46*a* or 46*b* is positioned at a limit angular position.

A second elastic member 52 such as a coil spring is interposed between the first arm 46*a* and the first rail 31 as well as between the first arm 46*b* and the first rail 31, respectively. The second elastic member 52 exhibits an elasticity sufficient to drive the first arm 46*a* or 46*b* toward the limit angular position in the normal direction through relative rotation around the support shaft 49*a* or 49*b*. The second elastic member 52 urges the first arm 46*a* or 46*b* against the restricting piece 51*a* or 51*b*. When the first arm 46*a* or 46*b* is driven to rotate around the support shaft 49*a* or 49*b* from the limit angular position in the reverse direction opposite to the normal direction, an elastic repulsive force is accumulated in the second elastic member 52 based on the swinging movement of the first arm 46*a* or 46*b*.

A lock member 53 is further related to the first arms 46*a*, 46*b*. The lock member 53 is common to both the link mechanisms 44*a*, 44*b*. The lock member 53 is designed to slide between first and second lock positions. When the lock member 53 is positioned at the first lock position, the lock member 53 is engaged with the first arm 46*a* at the limit angular position in the link mechanism 44*a*. The first arm 46*a* is thus held at the limit angular position in the link mechanism 44*a*. On the other hand, when the lock member 53 is positioned at the second lock position, the lock member 53 is engaged with the first arm 46*b* at the limit angular position in the link mechanism 44*b*. The first arm 46*b* is thus held at the limit angular position in the link mechanism 44*b*. The lock member 53 always holds one of the first arms 46*a*, 46*b* in the link mechanism 44*a* or 44*b*. In other words, one of the first arms 46*a*, 46*b* is always released from the restriction of the lock member 53 in the link mechanism 44*a* or 44*b*.

An electromagnetic solenoid 54 is connected to the lock member 53. The electromagnetic solenoid 54 is designed to shift its stem 54*a* between front and retreat positions in response to the supply of a pulse signal, for example. When the stem 54*a* is positioned at the front position, the lock member 53 is positioned at the first lock position. On the other hand, when the stem 54*a* is positioned at the retreat position, the lock member 53 is positioned at the second lock position. The pulse signal is supplied from the aforementioned controller 25, for example. A pair of motion sensors 55*a*, 55*b* are connected to the controller 25 for the control of the electromagnetic solenoid 54. Each of the motion sensors 55*a*, 55*b* includes a light emitting element and a light receiving element, for example. If light of the light emitting element reflects from an object, the light receiving element detects the reflected light. This results in detection of the existence of the object. The motion sensors 55*a*, 55*b* are fixed to predetermined positions on the first rail 31 as described later.

Rotation shafts 56*a*, 56*b* are supported on the second arms 47*a*, 47*b* at the tip ends of the second arms 47*a*, 47*b*, respectively. The rotation shafts 56*a*, 56*b* extend in parallel with the connecting pins 45*a*, 45*b*, respectively. The rotation shafts 56*a*, 56*b* are spaced from the connecting pins 45*a*, 45*b* by a second distance larger than the aforementioned first distance, respectively. Rollers 57*a*, 57*b* are supported on the rotation shafts 56*a*, 56*b* for relative rotation, respectively. The rollers 57*a*, 57*b* may be made of an elastic material such as rubber. The rollers 57*a*, 57*b* function as contact members according to the present invention. The link mechanisms 44*a*, 44*b* are set symmetric relative to a vertical plane.

Figure 6:
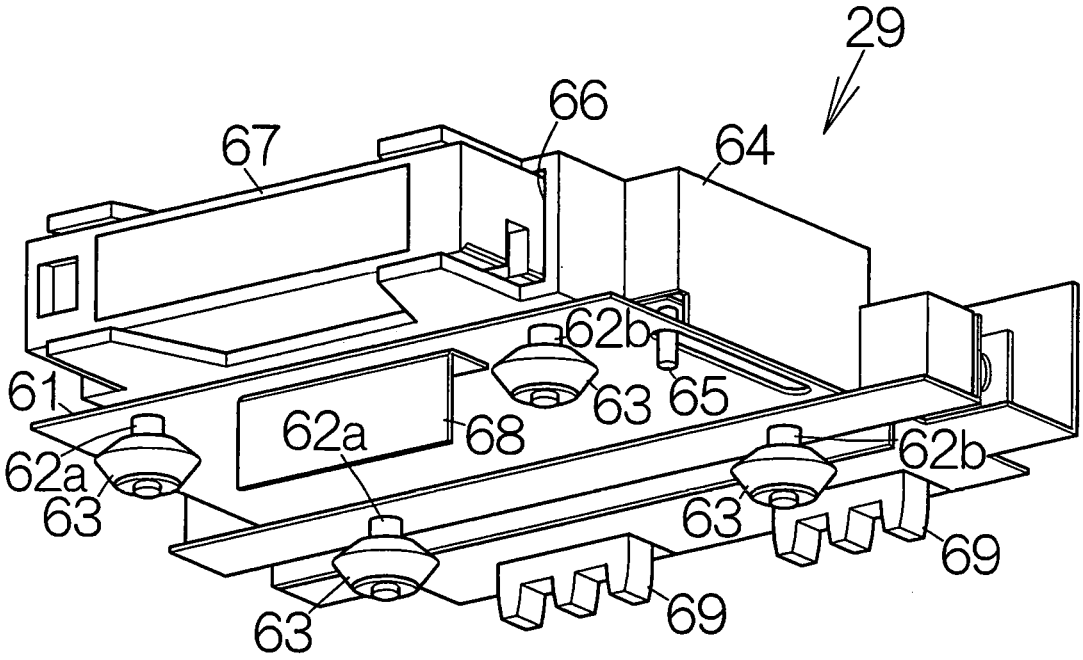
FIG. 6 is an enlarged perspective view schematically illustrating the structure of a carriage.

As shown in FIG. 6, the carriage 29 includes a base 61. Left and right pairs of vertical pins 62*a*, 62*a* and 62*b*, 62*b* are attached to the base 61. The vertical pins 62*a*, 62*a*, 62*b*, 62*b* are designed to extend downward. The space between the left pair of the vertical pins 62*a*, 62*a* is set equal to the space between the right pair of vertical pins 62*b*, 62*b*. A small-sized roller 63 is mounted on each of the vertical pins 62*a*, 62*b* for relative rotation. The small-sized rollers 63 are formed in an identical shape. The centroids of the small-sized rollers 63 are located within an imaginary plane perpendicular to the vertical pins 62*a*, 62*b*.

A movable block 64 is mounted on the base 61. The movable block 64 is designed to move in the longitudinal direction in parallel with an imaginary plane extending between the vertical pins 62*a*, 62*a* or 62*b*, 62*b*. A guiding pin 65 is attached to the movable block 64. The guiding pin 65 extends downward in the vertical direction.

A cell 66 is defined in the movable block 64. The cell 66 is designed to accept insertion of the magnetic tape cartridge 67. The robot hands 23 of the individual transporting robots 18 are capable of inserting the magnetic tape cartridge 67 into the cell 66. The robot hands 23 of the individual transporting robots 18 are also capable of withdrawing the magnetic tape cartridge 67 out of the cell 66.

A screen 68 is attached to the base 61. The screen 68 extends downward in the vertical direction. The screen 68 is designed to extend in parallel with an imaginary plane extending between the left and right vertical pins 62*a*, 62*b*. The screen 68 serves to reflect the light from the aforementioned motion sensors 55*a*, 55*b*.

Figure 7:
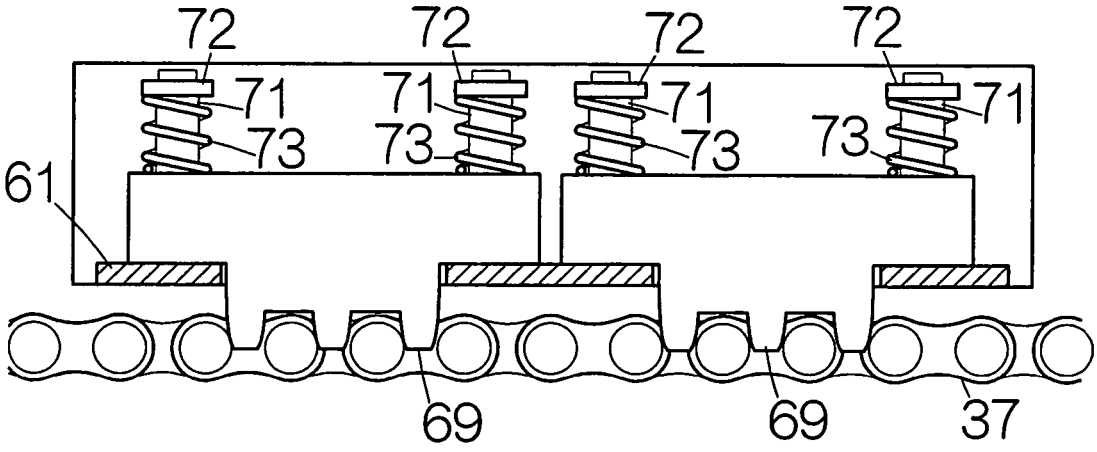
FIG. 7 is a rear view illustrating the structure of a rack in detail.

Racks 69, 69 are further mounted on the base 61. The racks 69, 69 are designed to extend in parallel with an imaginary plane extending between the left and right vertical pins 62*a*, 62*b*. The racks 69, 69 include dents extending downward, respectively. As shown in FIG. 7, the individual racks 69, 69 are mounted on vertical pins 71, 71 standing upright from the base 61. The vertical pins 71, 71 guide the vertical movement of the racks 69, 69, respectively.

A flange 72 is formed at the upper end of each of the vertical pins 71. An elastic member 73 such as a coil spring is interposed between the flange 72 and the rack 69. The elastic member 73 exhibits an elasticity sufficient to urge the rack 69 against the base 61 in the vertical direction. When an upward urging force acts on the rack 69 in the vertical direction, the rack 69 moves upward against the elasticity of the elastic member 73. An elastic repulsive force is thus accumulated in the elastic member 73. When the rack 69 is released from the upward urging force, the elastic repulsive force of the elastic member 73 drives the rack 69 downward toward the base 61.

Figure 8:
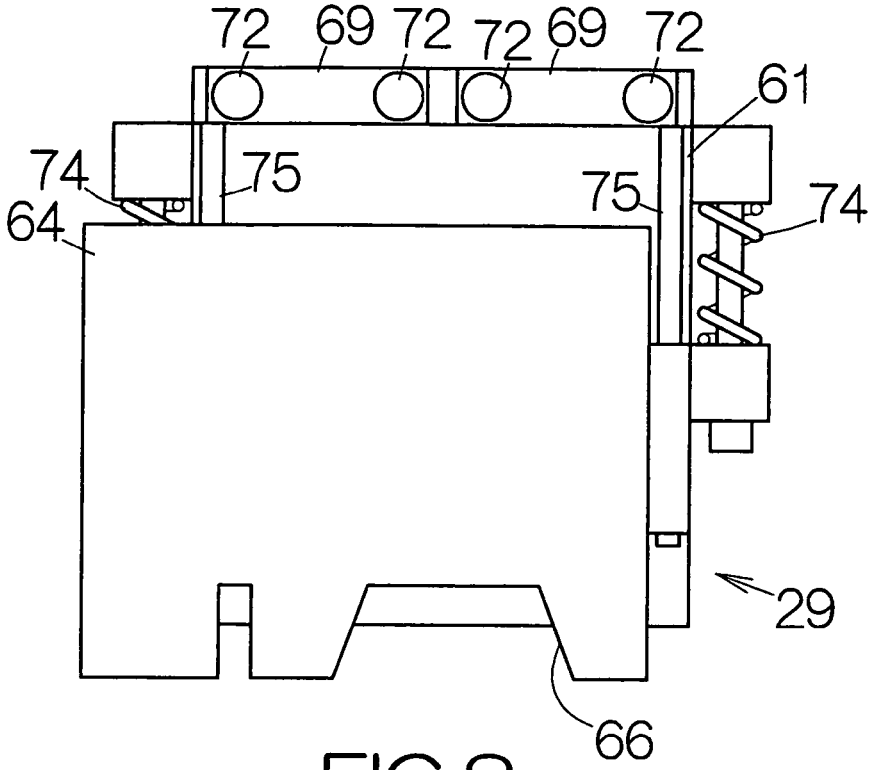
FIG. 8 is a plan view of the carriage.

As shown in FIG. 8, elastic members 74, 74 such as coil springs are interposed between the base 61 and the movable block 64. The elastic members 74 exhibit an elasticity sufficient to drive the movable block 64 forward along guiding shafts 75, 75. When a backward urging force acts on the aforementioned guiding pin 65, the movable block 64 moves backward against the elasticity of the elastic members 74. An elastic repulsive force is thus accumulated in the elastic members 74. When the guiding pin 65 is released from the backward urging force, the elastic repulsive force of the elastic member 74 drives the moveable block 64 forward.

Figure 9:
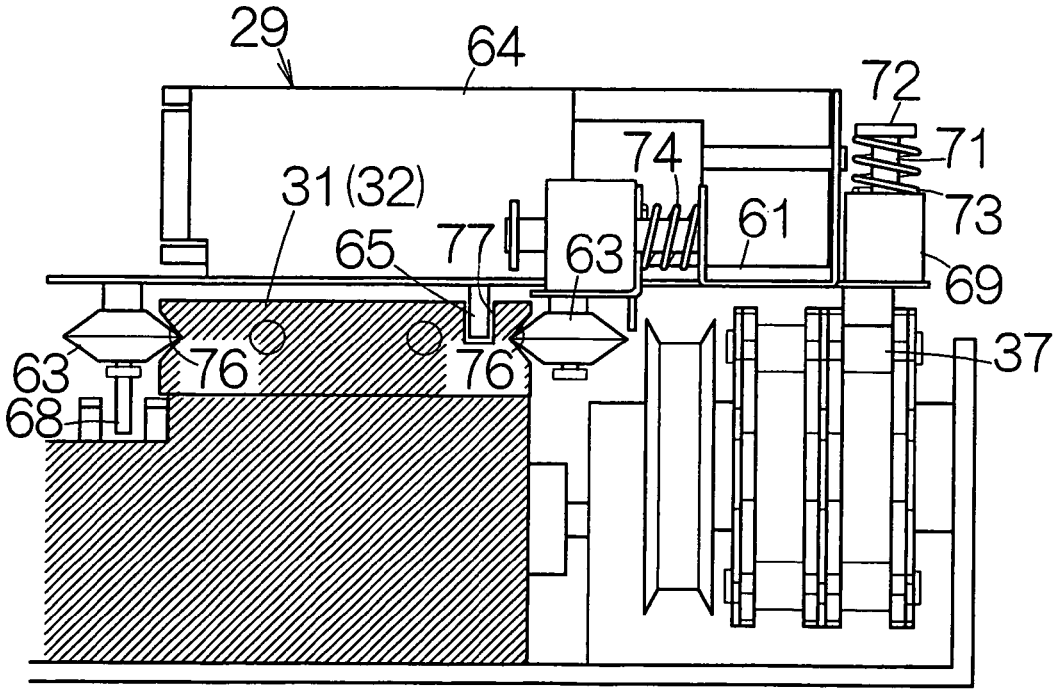
FIG. 9 is a side view schematically illustrating the relationship between the carriage and a first or second rail.

As shown in FIG. 9, a pair of notches 76, 76 are defined in each of the first and second rails 31, 32, 32. The notches 76 are designed to extend in the longitudinal direction of the first and second rails 31, 32, 32. The notches 76, 76 are formed on a pair of vertical surfaces parallel to each other, respectively. The small-sized rollers 63 of the carriage 29 are received in the corresponding notches 76. The first and second rails 31, 32, 32 are interposed between the left pair of the small-sized rollers 63, 63 as well as between the right pair of the small-sized rollers 63, 63. The first and second rails 31, 32 are in this manner allowed to guide the movement of the carriage 29. The vertical movement of the carriage 29 is restricted.

Figure 10:
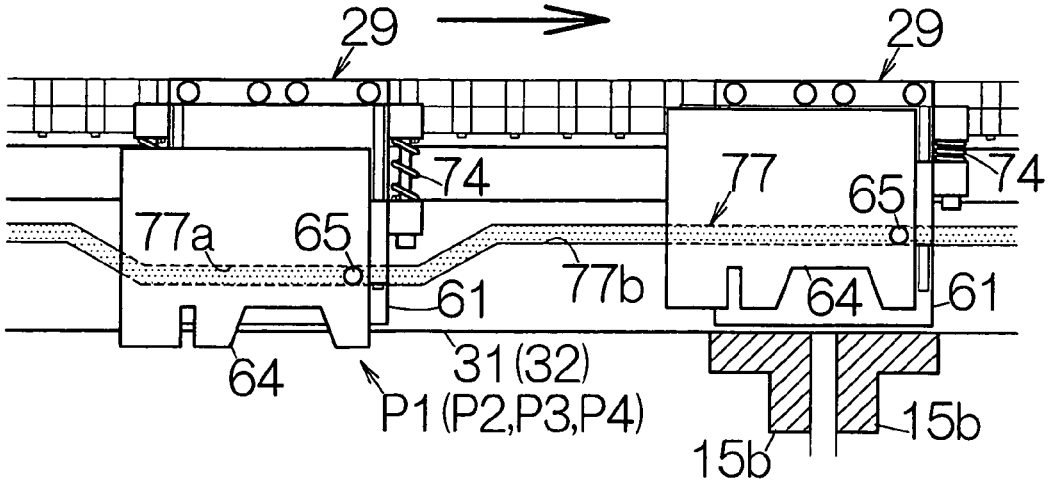
FIG. 10 is a plan view schematically illustrating the movement of a movable block on the carriage.

When the carriage 29 is mounted on the first and second rails 31, 32 in the aforementioned manner, the guiding pin 65 of the movable block 64 is received in a guiding groove 77 defined in the first and second rails 31, 32, 32. As shown in FIG. 10, the guiding groove 77 includes first linear sections 77*a* and second linear sections 77*b*. The first linear section 77*a* is designed to extend along a first straight line in each of the aforementioned first to fourth loading positions P1-P4. The second linear section 77*b* is designed to extend along a second straight line parallel to the first straight line in an intermediate area between the loading positions P1-P4. The first linear sections 77*a* are located at the farthest front of the first rail 31 or the second rail 32. In other words, the first linear sections 77*a* get closest to the corresponding transporting robot 18. The second linear sections 77*b* recede from the first linear sections 77*a*.

When the carriage 29 is positioned at one of the first to fourth loading positions P1-P4, the guiding pin 65 of the carriage 29 is held in the first linear section 77*a* of the guiding groove 77. The elastic member 74 drives the movable block 64 forward to the utmost. The magnetic tape cartridge is exchanged between the movable block 64 at the farthest front and the robot hand 23 of the corresponding transporting robot 18. On the other hand, when the carriage 29 moves from one of the loading position P1-P4 toward the adjacent one, the guiding pin 65 moves toward the second linear section 77*b*. The guiding groove 77 functions as a driving cam. The movable block 64 moves backward against the elasticity of the elastic members 74 in the carriage 29. The movable block 64 is thus allowed to move around the support column 15*b*. The movable block 64 is prevented from collision against the column 15*b*.

Figure 11:
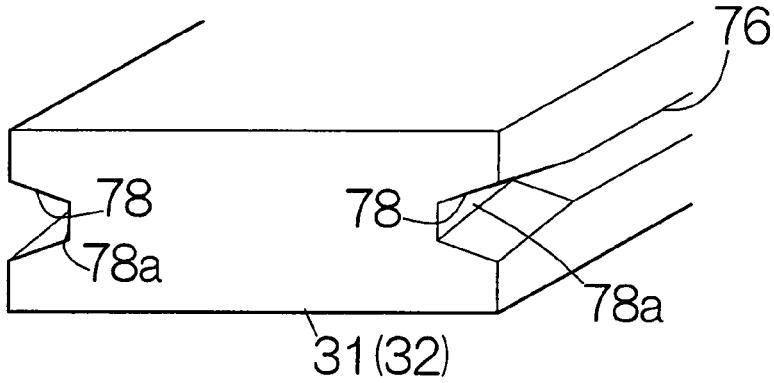
FIG. 11 is an enlarged perspective view schematically illustrating an end surface of the first or second rail.
Figure 12:
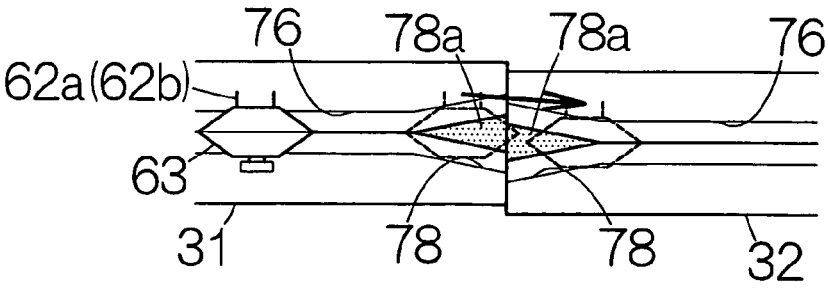
FIG. 12 is a side view schematically illustrating the connection between the rails.

As shown in FIG. 11, a flat-bottomed groove 78 is connected to the end of the individual notch 76 at the end surface of the first rail 31 or the second rail 32. The flat-bottomed groove 78 includes a bottom 78*a* defined in the shape of an isosceles triangle. The isosceles triangle has legs extending from the bottom of the notch 76 to the base aligned with the end surface of the first rail 31 or the second rail 32. The bottom 78*a* of the flat-bottomed groove 78 is flush with the bottom of the notch 76. The flat-bottomed groove 78 allows displacement of the small-sized the rollers 63 along the width of the groove 78. As is apparent from FIG. 12, the small-sized roller 63 has the largest periphery within an imaginary horizontal plane perpendicular to the vertical pins 62*a*, 62*b*. The diameter of the small-sized roller 63 decreases as the roller 63 gets distanced from the imaginary horizontal plane along the vertical pin 62*a* or 62*b*. This structure enables a reliable movement of the small-sized roller 63 across the boundaries between the first and second rails 31, 32, 32 irrespective of any difference in the level or height between the adjacent rails 31, 32, 32.

Next, a detailed description will be made on the operation of the connection mechanism 43. Now, assume that the carriage 29 moves from the first rail 31 to the second rail 32. First of all, the first and second arms 46*a*, 47*a* and 46*b*, 47*b* take the second bending attitude in the link mechanism 44*a*, 44*b* based on the action of the first elastic member 48. In addition, the first arm 46*a*, 46*b* is urged against the corresponding restricting piece 51*a*, 51*b* through a relative rotation around the support shaft 49*a*, 49*b* based on the action of the second elastic member 52. The lock member 53 is held at the first lock position. The lock member 53 is engaged with the first arm 46*a* located at the limit angular position in the link mechanism 44*a*.

Figure 13:
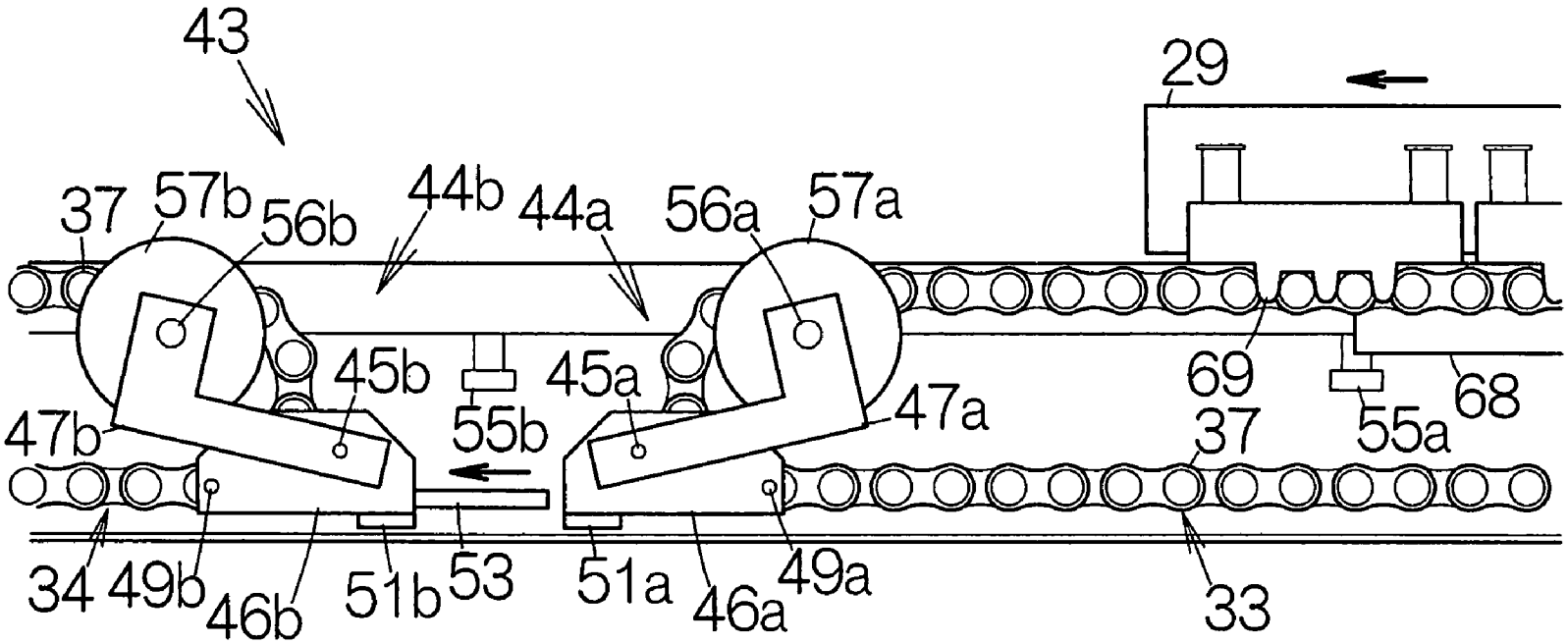
FIG. 13 is a side view of the first transporting rail unit for schematically illustrating the carriage moving onto the connection mechanism from the first rail.

When the first driving apparatus 33 drives the chain belt 37 in the normal direction, the carriage 29 moves forward on the first rail 31. The racks 69 of the carriage 29 engage with the chain belt 37 of the first driving apparatus 33. As shown in FIG. 13, the screen 68 of the carriage 29 then passes by the motion sensor 55*a* prior to the contact of the carriage 29 with the roller 57*a*. The light receiving element receives the reflected light in the motion sensor 55*a*. The motion sensor 55*a* thus supplies a detection signal to the controller 25. The controller 25 supplies a pulse signal to the electromagnetic solenoid 54 in response to the reception of the detection signal. The supply of the pulse signal triggers the backward movement of the stem 54*a* to the retreat position in the electromagnetic solenoid 54. The lock member 53 shifts to the second lock position. The lock member 53 holds the first arm 46*b* on the restricting piece 51*b* in the link mechanism 44*b*. The first arm 46*a* is released from the restriction of the lock member 53 in the link mechanism 44*a*.

Figure 14:
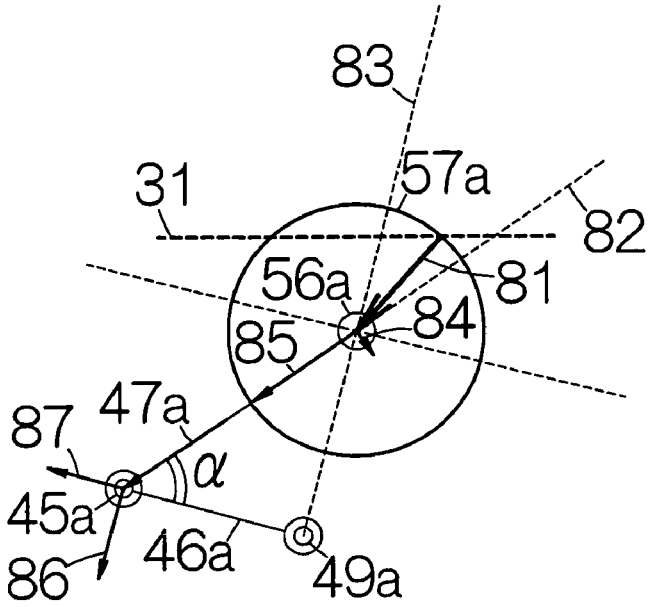
FIG. 14 is a vector diagram schematically illustrating a relationship between a force applied to a roller and a rotational force around a support shaft when the carriage is transferred from the first driving apparatus to a second driving apparatus.

The carriage 29 then contacts with the roller 57*a* at a contact starting position. A further forward movement of the carriage 29 generates a force 81 applied from the carriage 29 to the rotation shaft 56*a* in the connection mechanism 43, as shown in FIG. 14. In other words, the longitudinal axis of the rotation shaft 56*a* functions as the point of action. The force 81 is applied to the longitudinal axis of the rotation shaft 56*a* from a specific location. The specific location is set outside a first imaginary plane 82 including the axes of the connecting pin 45*a* and the rotation shaft 56*a*. The first arm 46*a* is in this case located inside the first imaginary plane 82. In addition, the specific location is located outside a second imaginary plane 83 including the axes of the support shaft 49*a* and the rotation shaft 56*a*. Here, the first and second arms 46*a*, 47*a* are located inside the second imaginary plane 83. The force 81 can be resolved into a rotational force 84 around the connecting pin 45*a* and a compressive force 85 along the second arm 47*a*. The roller 57*a* thus moves downward around the connecting pin 45*a* based on the rotational force 84. The carriage 29 in this manner serves to move the roller 57*a* downward. An elastic repulsive force is gradually accumulated in the first elastic member 48 during the downward movement of the roller 57*a*.

In this case, the compressive force 85 acts on the connecting pin 45*a*. The compressive force 85 can be resolved into a rotational force 86 around the support shaft 49*a* and an tensility 87 along the first arm 46*a*. The rotational force 86 serves to urge the first arm 46*a* against the restricting piece 51*a*. The first arm 46*a* can thus be held at the limit angular position even without the restriction of the lock member 53.

Figure 15:
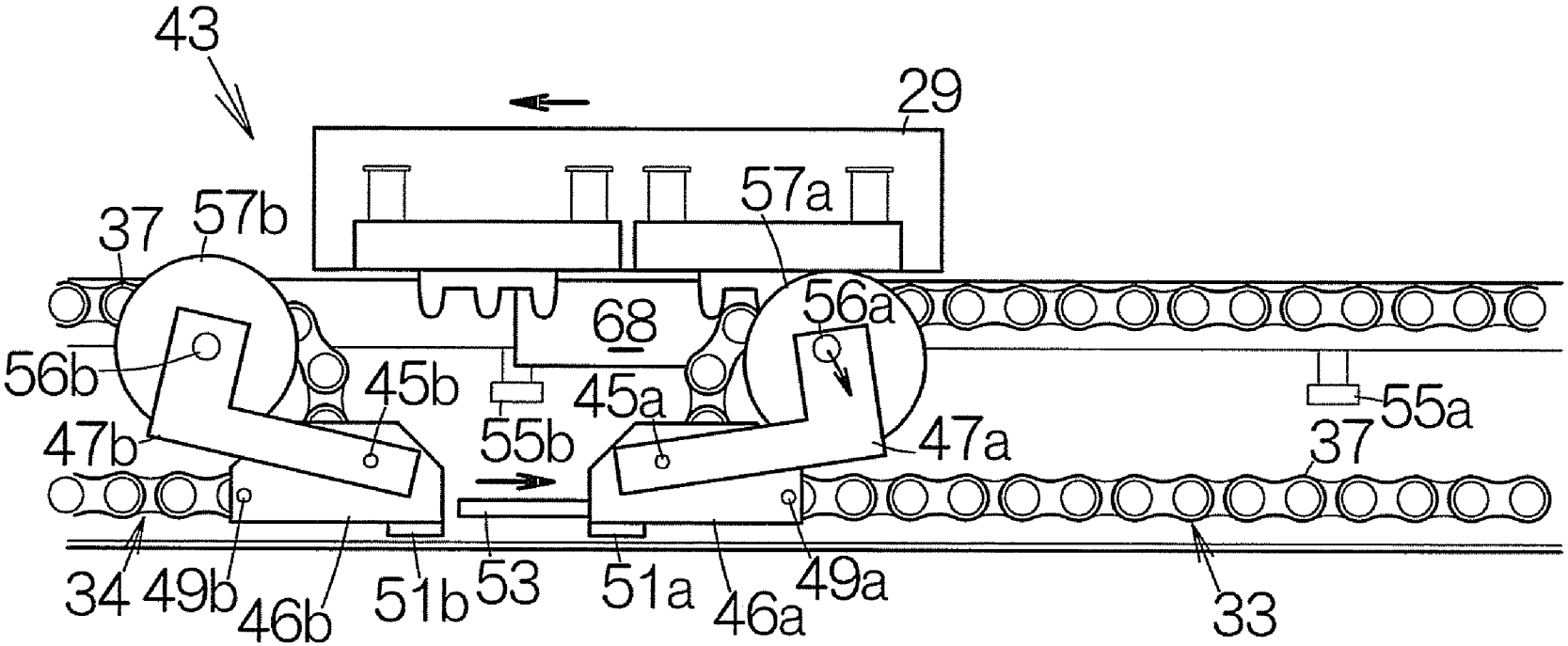
FIG. 15 is a side view of the first transporting rail unit for schematically illustrating the carriage passing by a motion sensor based on guidance of the connection mechanism.

As shown in FIG. 15, the screen 68 of the carriage 29 then passes by the motion sensor 55*b*. The motion sensor 55*b* correspondingly supplies a detection signal to the controller 25. The controller 25 supplies a pulse signal to the electromagnetic solenoid 54 in response to the reception of the detection signal. The supply of the pulse signal triggers the forward movement of the stem 54*a* to the front position in the electromagnetic solenoid 54. The lock member 53 shifts to the first lock position. The lock member 53 holds the first arm 46*a* on the restricting piece 51*a* in the link mechanism 44*a*. The first arm 46*b* is released from the restriction of the lock member 53 in the link mechanism 44*b*. The carriage 29 sits on the top of the roller 57*a* in the link mechanism 44*a*. This results in establishment of the first bending attitude between the first and second arms 46*a*, 47*a* in the link mechanism 44*a*. The maximum elastic repulsive force is accumulated in the first elastic member 48. Here, the carriage 29 still keeps engaged with the chain belt 37 of the first driving apparatus 33.

Figure 16:
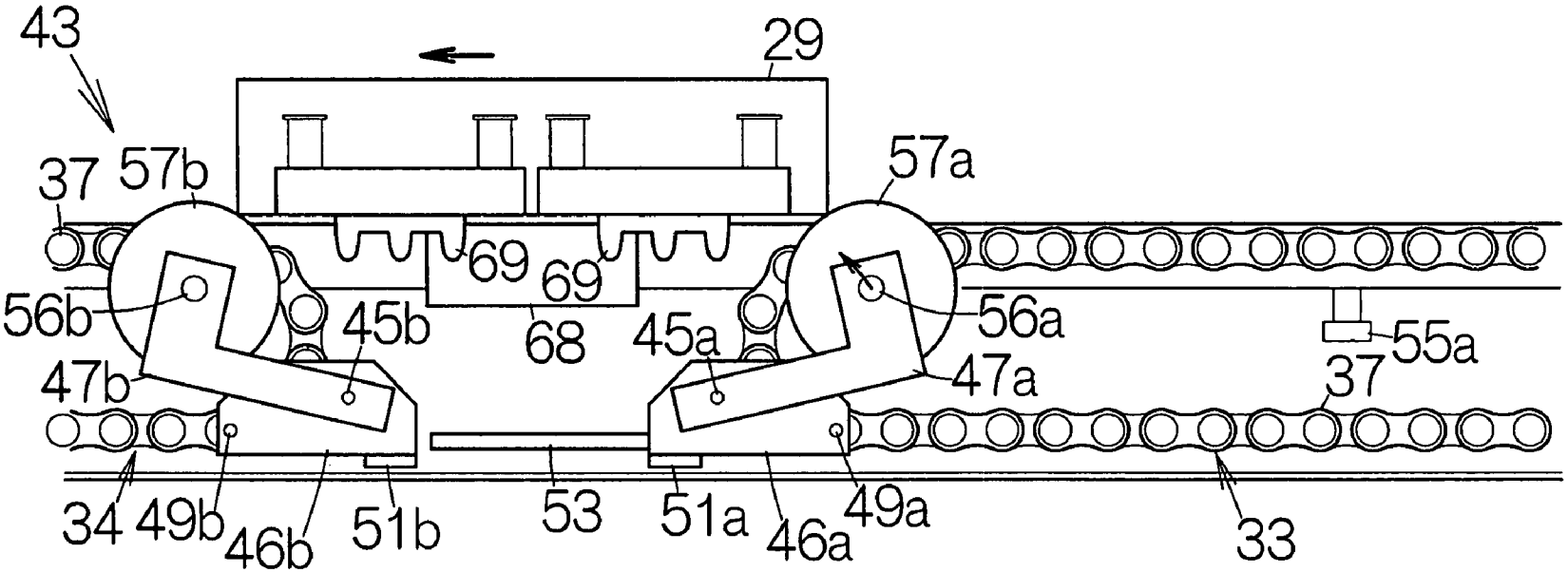
FIG. 16 is a side view of the first transporting rail unit for schematically illustrating the carriage disengaged from both the first and second driving apparatuses.

As shown in FIG. 16, when the carriage 29 reaches a release position, the carriage 29 gets over the top of the roller 57*a*. The roller 57*a* thus starts moving upward around the connecting pin 45*a* based on the elastic repulsive force accumulated in the first elastic member 48. The racks 69 are simultaneously disengaged from the chain belt 37 of the first driving apparatus 33. The carriage 29 gets released from the restriction of the first driving apparatus 33. A driving force is applied to the carriage 29 from the roller 57*a* based on the elastic repulsive force of the first elastic member 48. The carriage 29 is thus allowed to keep moving forward to the second rail 32. The carriage 29 then contacts with the roller 57*b* of the link mechanism 44*b* prior to engagement with the second driving apparatus 34.

Figure 17:
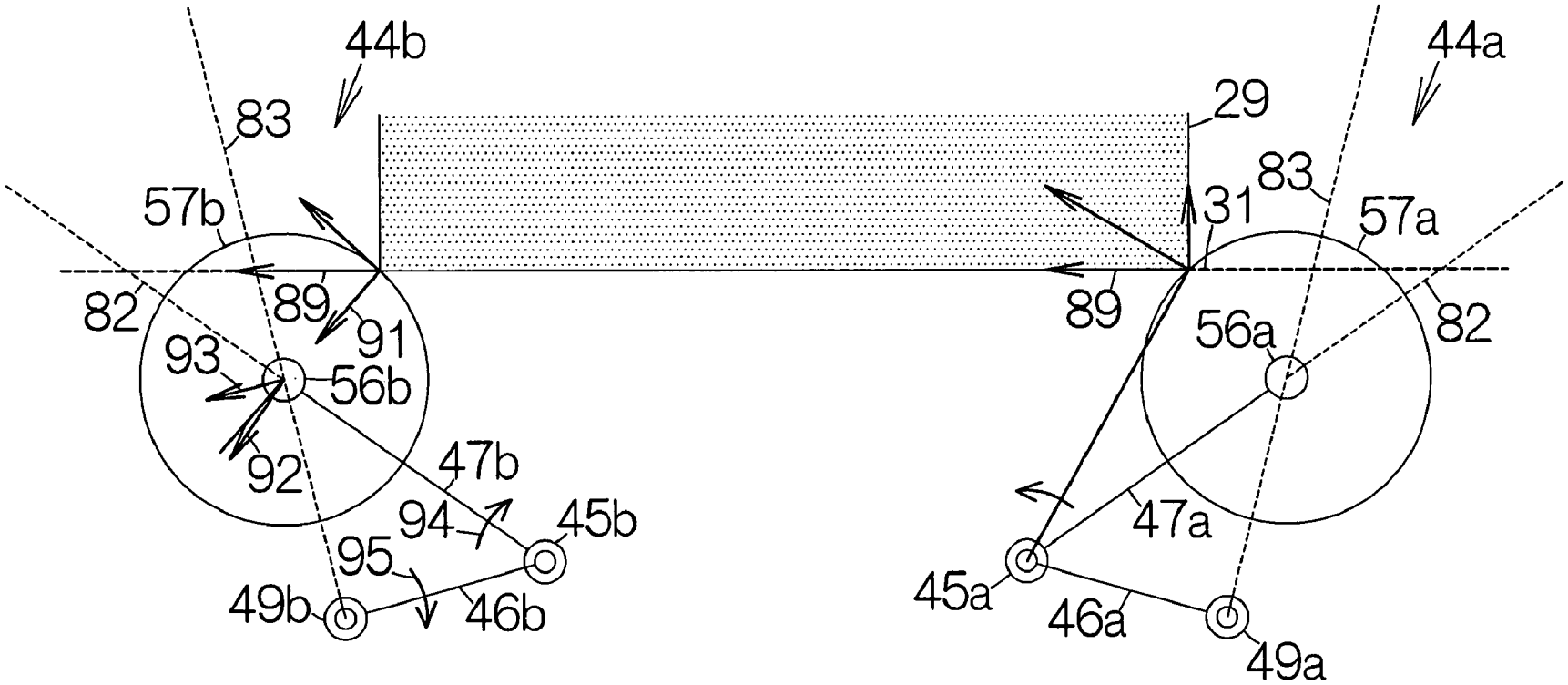
FIG. 17 is a vector diagram schematically illustrating a relationship between forces of rollers.
Figure 18:
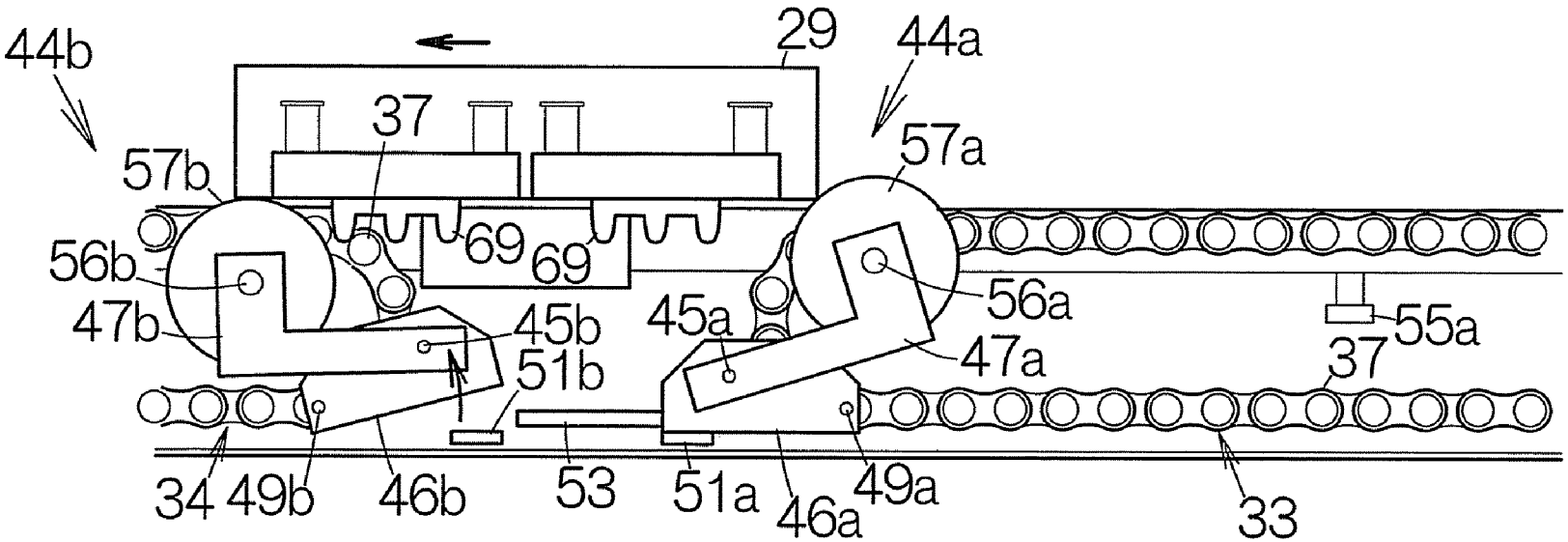
FIG. 18 is a side view of the first transporting rail unit for schematically illustrating the carriage connected to the second driving apparatus based on the guidance of the connection mechanism.

Here, as shown in FIG. 17, a component 91 of the driving force 89 is applied to the longitudinal axis of the rotation shaft 56*b*, namely the point of action, through the roller 57*b*. Specifically, the component 91 is applied to the longitudinal axis of the rotation shaft 56*b* from a specific location. The specific location is set outside a first imaginary plane 82 including the axes of the connecting pin 45*b* and the rotation shaft 56*b*. The first arm 46*b* is in this case located inside the first imaginary plane 82. In addition, the specific location is located inside a second imaginary plane 83 including the axes of the support shaft 49*b* and the rotation shaft 56*b*. Here, the first and second arms 46*b*, 47*b* are located inside the second imaginary plane 83. The component 91 generates a rotational force 92 around the connecting pin 45*b*. The component 91 also generates a rotational force 93 around the support shaft 49*b*. The elasticity of the first elastic member 48 generates a rotational force 94 around the connecting pin 45*b* in the link mechanism 44*b*. The rotational force 94 overcomes the rotational force 92 of the force component 91. The second bending attitude is thus kept in the link mechanism 44*b*. Although the elasticity of the second elastic member 52 generates a rotational force 95 around the support shaft 49*b* in the link mechanism 44*b*, the rotational force 93 of the force component 91 keeps overcoming the rotational force 95. The first arm 46*b* is thus allowed to swing around the support shaft 49*b* from the limit angular position in the reverse direction, as shown in FIG. 18. The first arm 46*b* gets distanced from the restricting piece 51*b*. An elastic repulsive force is gradually accumulated in the second elastic member 52 during the swinging movement of the first arm 46*b*. The swinging movement of the first arm 46*b* causes the roller 57*b* to move downward. The carriage 29 is thus allowed to keep moving.

The driving force from the roller 57*a* keeps the carriage 29 moving forward. The racks 69 of the carriage 29 then engage with the chain belt 37 of the second driving apparatus 34. The carriage 29 receives a driving force from the second driving apparatus 34. The carriage 29 in this manner reaches the second rail 32. When the carriage 29 has passed over the roller 57*b*, the first arm 46*b* returns to the limit angular position based on the elastic repulsive force of the second elastic member 52. The first and second arms 46*a*, 47*a* and 46*b*, 47*b* thus take the second bending attitude in the link mechanisms 44*a*, 44*b*. The lock member 53 is held at the first lock position.

Figure 19:
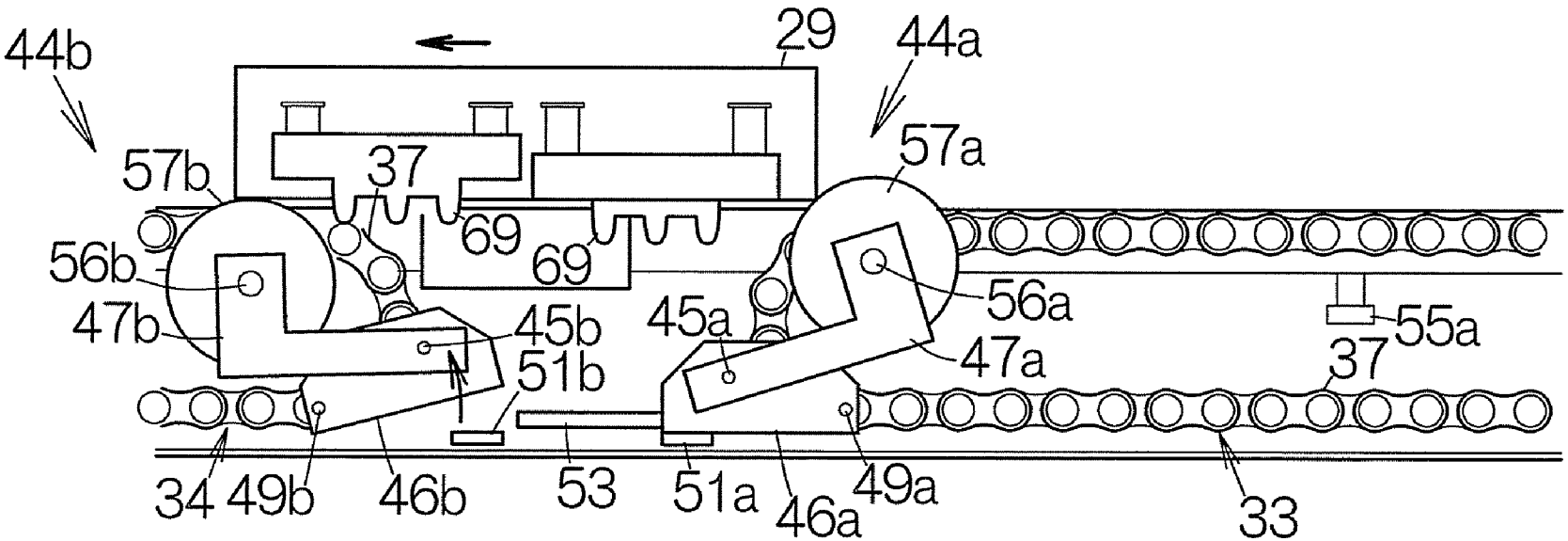
FIG. 19 is a side view of the first transporting rail unit for schematically illustrating the carriage connected to the second driving apparatus based on the guidance of the connection mechanism when the carriage advances to the second driving apparatus off the correct timing.

As shown in FIG. 19, even if the rack 69 advances to the chain belt 37 off the correct timing, the rack 69 is allowed to move in the vertical direction in response to the collision against the chain belt 37. This movement of the rack 69 allows the chain belt 37 to keep moving without engagement with the carriage 29. The carriage 29 stays where it is, to await the correct timing of the engagement. The forward movement of the rack 69 eventually adjusts to the rotation of the chain belt37, so that the rack 69 moves downward based on the elastic repulsive force of the elastic member 73. The rack 69 in this manner reliably engages with the chain belt 37.

The connection mechanism 43 of the type allows the carriage 29 to be completely disengaged from both the first and second driving apparatuses 33, 34 when the carriage 29 is transferred from the first driving apparatus 33 to the second driving apparatus 34. Accordingly, even if the second driving apparatus 34 fails to synchronize with the first driving apparatus 33, the carriage 29 can reliably be transferred from the first driving apparatus 33 to the second driving apparatus 34.

Next, assume that the carriage 29 moves from the second rail 32 to the first rail 31. The carriage 29 is driven to move backward based on the reverse movement of the second driving apparatus 34. The rack 69 engages with the chain belt 37 of the second driving apparatus 34. The lock member 53 holds the first arm 46*a* on the restricting piece 51*a* in the link mechanism 44*a*. The first arm 46*b* is released from the restriction of the lock member 53 in the link mechanism 44*b*.

Figure 20:
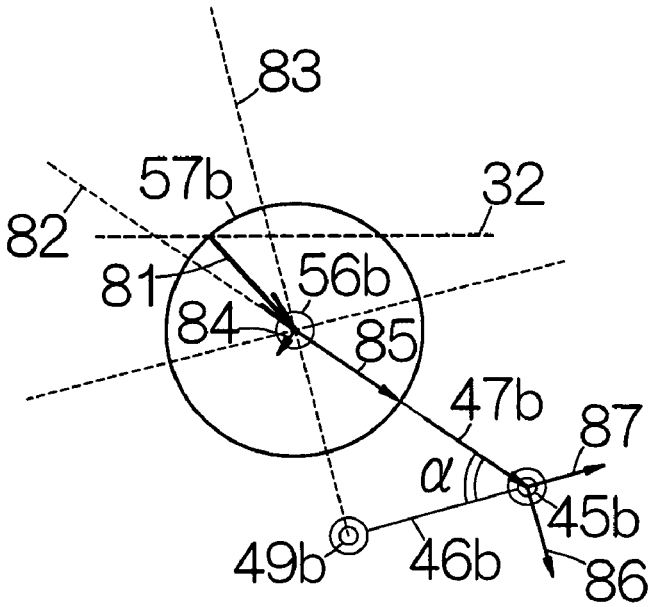
FIG. 20 is a vector diagram schematically illustrating a relationship between a force applied to the roller and a rotational force around a support shaft when the carriage is transferred from the second driving apparatus to the first driving apparatus.

The carriage 29 then contacts with the roller 57*b* at a contact starting position. A further backward movement of the carriage 29 generates a force 81 applied from the carriage 29 to the rotation shaft 56*b* in the connection mechanism 43, as shown in FIG. 20. Since the link mechanisms 44*a*, 44*b* are set symmetrical relative to the vertical plane, the longitudinal axis of the rotation shaft 56*b* functions as the point of action in the same manner as described above. The force 81 is applied to the longitudinal axis of the rotation shaft 56*b* from a specific location. The specific location is set outside a first imaginary plane 82 including the axes of the connecting pin 45*b* and the rotation shaft 56*b*. The first arm 46*b* is in this case located inside the first imaginary plane 82. In addition, the specific location is located outside a second imaginary plane 83 including the axes of the support shaft 49*b* and the rotation shaft 56*b*. Here, the first and second arms 46*b*, 47*b* are located inside the second imaginary plane 83. The force 81 can be resolved into a rotational force 84 around the connecting pin 45*b* and a compressive force 85 along the second arm 47*b*. The roller 57*b* thus moves downward around the connecting pin 45*b* based on the rotational force 84. The compressive force 85 along the second arm 47*b* simultaneously acts on the connecting pin 45*b*. The compressive force 85 can be resolved into a rotational force 86 around the support shaft 49*b* and an tensility 87 along the first arm 46*b*. The rotational force 86 serves to urge the first arm 46*b* against the restricting piece 51*b*. The first arm 46*b* can thus be held at the limit angular position even without the restriction of the lock member 53.

A further backward movement of the carriage 29 allows the carriage 29 to get over the top of the roller 57*b* in the link mechanism 44*b*. The first and second arms 46*b*, 47*b* are forced to take the first bending attitude in the link mechanism 44*b*. An elastic repulsive force is accumulated in the first elastic member 48 to the utmost.

Figure 21:
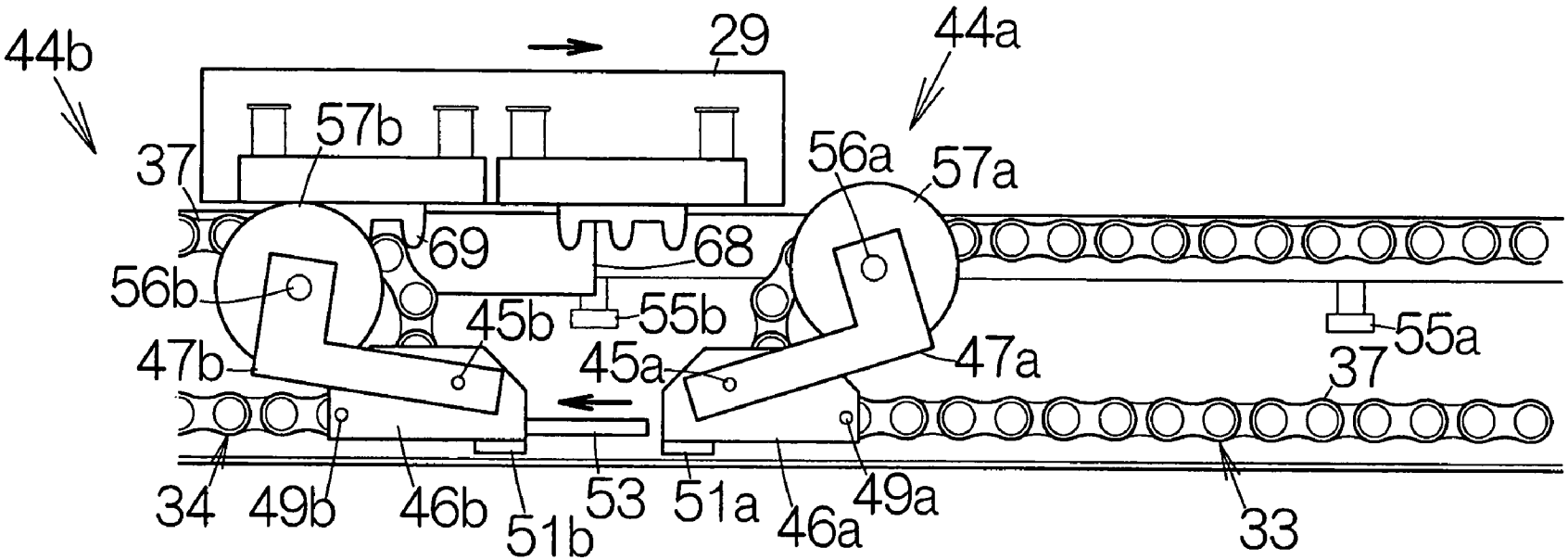
FIG. 21 is a side view of the first transporting rail unit for schematically illustrating the carriage passing by a motion sensor based on the guidance of the connection mechanism when the carriage moves onto the connection mechanism from the second rail.

As shown in FIG. 21, the screen 68 of the carriage 29 then passes by the motion sensor 55*b*. The motion sensor 55*b* correspondingly supplies a detection signal to the controller 25. The controller 25 supplies a pulse signal to the electromagnetic solenoid 54 in response to the reception of the detection signal. The supply of the pulse signal triggers the backward movement of the stem 54*a* to the retreat position in the electromagnetic solenoid 54. The lock member 53 shifts to the second lock position. The lock member 53 holds the first arm 46*b* on the restricting piece 51*b* in the link mechanism 44*b*. The first arm 46*a* is released from the restriction of the lock member 53 in the link mechanism 44*a*.

Figure 22:
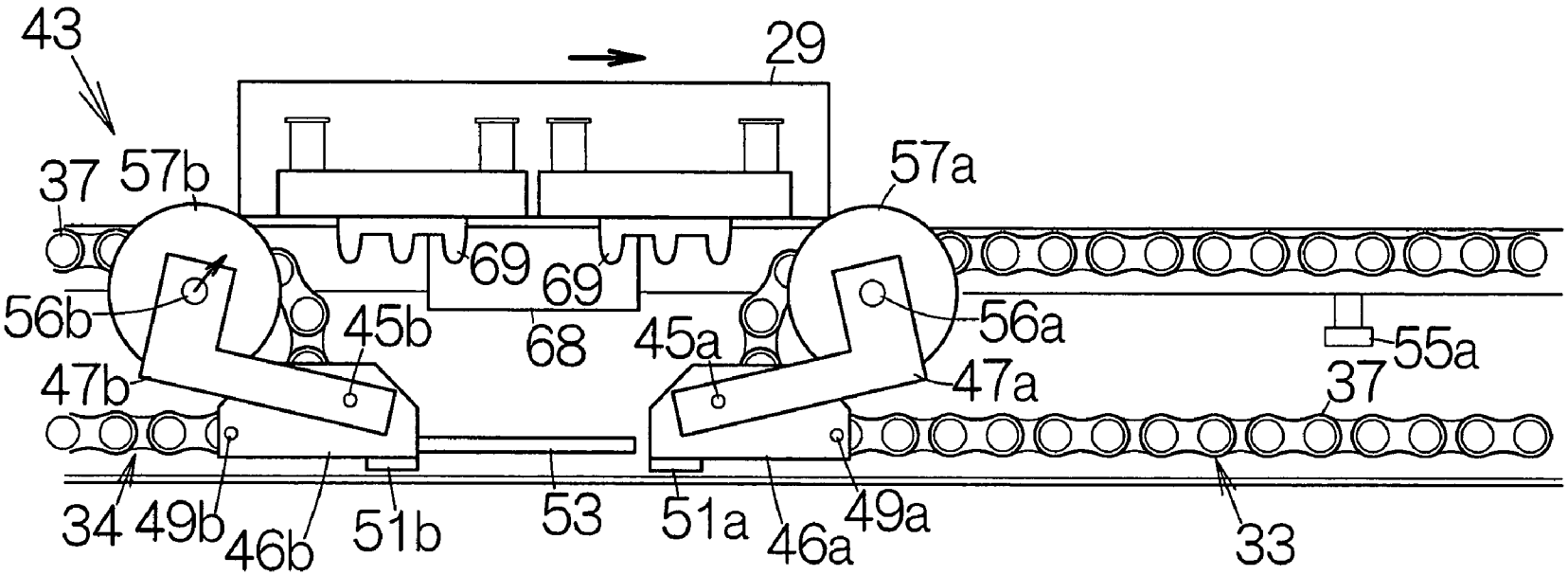
FIG. 22 is a side view of the first transporting rail unit for schematically illustrating the carriage disengaged from both the first and second driving apparatuses.

As shown in FIG. 22, when the carriage 29 reaches a release position, the carriage 29 gets over the top of the roller 57*b*. The roller 57*b* thus starts moving upward around the connecting pin 45*b* based on the elastic repulsive force accumulated in the first elastic member 48. The rack 69 are simultaneously disengaged from the chain belt 37 of the second driving apparatus 34. The carriage 29 gets released from the restriction of the second driving apparatus 34. A driving force is applied to the carriage 29 from the roller 57*b* based on the elastic repulsive force of the first elastic member 48. The carriage 29 is thus allowed to keep moving backward to the first rail 31. The carriage 29 then contacts with the roller 57*a* of the link mechanism 44*a* prior to engagement with the first driving apparatus 33.

Figure 23:
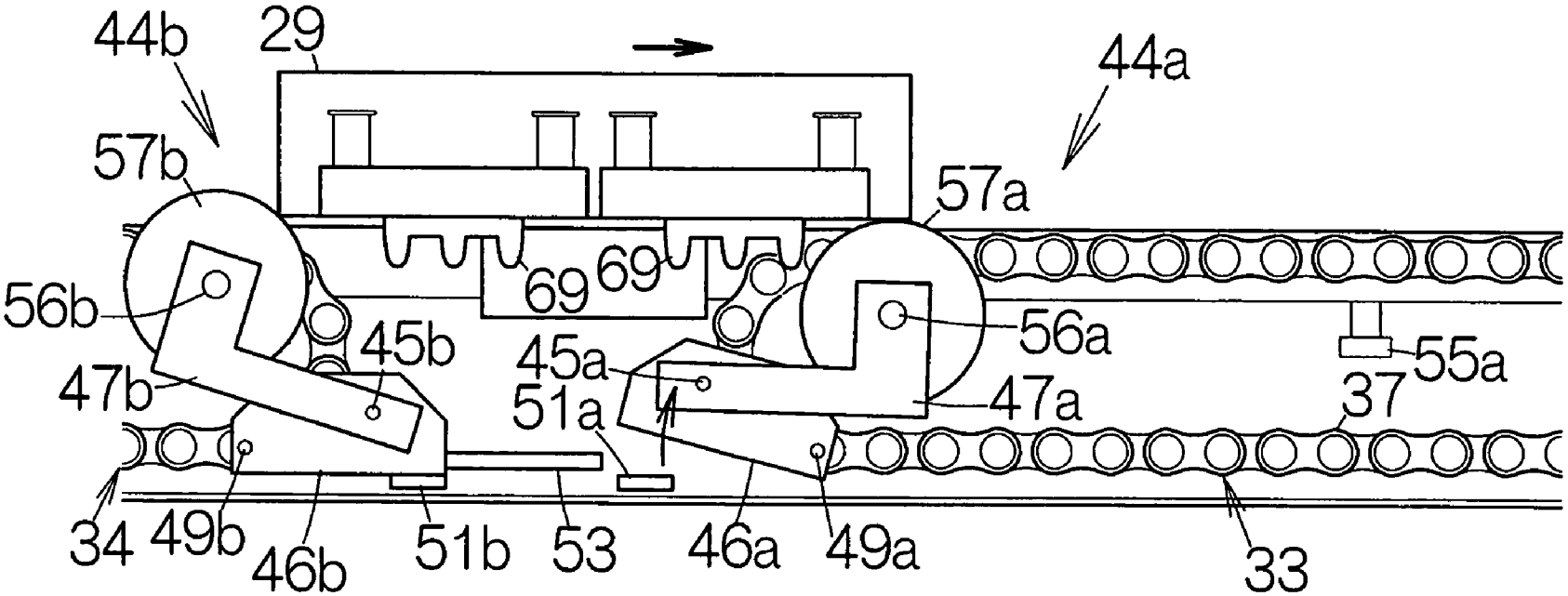
FIG. 23 is a side view of the first transporting rail unit for schematically illustrating the carriage connected to the first driving apparatus based on the guidance of the connection mechanism.

The driving force keeps acting on the carriage 29 from the link mechanism 44*b* in the same manner as described above. The first arm 46*a* is allowed to swing around the support shaft 49*a* from the limit angular position in the reverse direction, as shown in FIG. 23. The first arm 46*a* gets distanced from the restricting piece 51*a*. An elastic repulsive force is gradually accumulated in the second elastic member 52 during the swinging movement of the first arm 46*a*. The swinging movement of the first arm 46*b* causes the roller 57*b* to move downward. The carriage 29 is thus allowed to keep moving backward.

The driving force from the roller 57*b* keeps the carriage 29 moving backward. The racks 69 of the carriage 29 then engage with the chain belt 37 of the first driving apparatus 33. The carriage 29 receives a driving force from the first driving apparatus 33. The carriage 29 in this manner reaches the first rail 31. When the carriage 29 has passed over the roller 57*a*, the first arm 46*a* returns to the limit angular position based on the elastic repulsive force of the second elastic member 52. The first and second arms 46*a*, 47*a* and 46*b*, 47*b* are thus forced to take the second bending attitude in the link mechanisms 44*a*, 44*b*.

Figure 24:
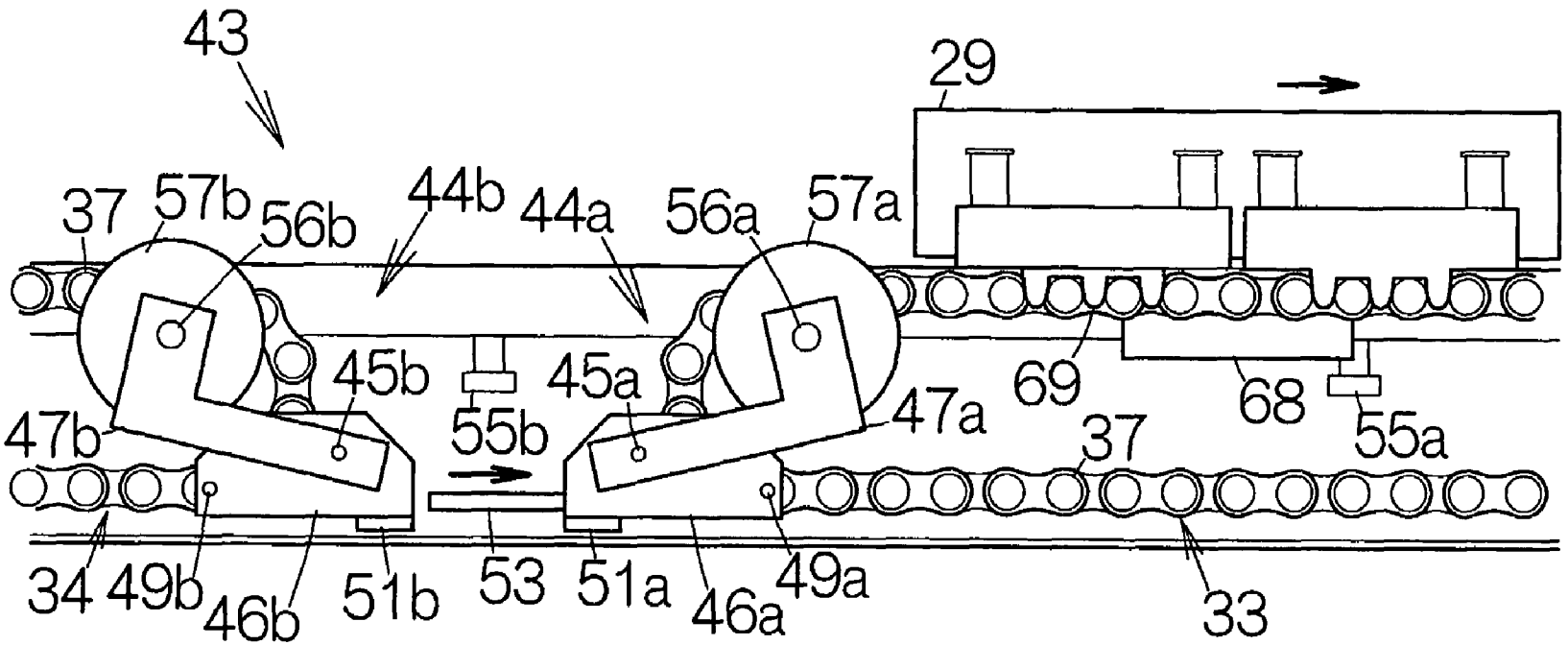
FIG. 24 is a side view of the first transporting rail unit for schematically illustrating the carriage passing by the motion sensor.

As shown in FIG. 24, the screen 68 of the carriage 29 then passes by the motion sensor 55*a*. The motion sensor 55*a* correspondingly supplies a detection signal to the controller 25. The controller 25 supplies a pulse signal to the electromagnetic solenoid 54 in response to the reception of the detection signal. The supply of the pulse signal triggers the forward movement of the stem 54*a* to the front position in the electromagnetic solenoid 54. The lock member 53 shifts back to the first lock position. The lock member 53 holds the first arm 46*a* on the restricting piece 51*a* in the link mechanism 44*a*. The first arm 46*b* is released from the restriction of the lock member 53 in the link mechanism 44*b*.

The connection mechanism 43 of the type allows the carriage 29 to be completely disengaged from both the first and second driving apparatuses 33, 34 when the carriage 29 is transferred from the second driving apparatus 34 to the first driving apparatus 33. Accordingly, even if the first driving apparatus 33 fails to synchronize with the second driving apparatus 34, the carriage 29 can reliably be transferred from the second driving apparatus 34 to the first driving apparatus 33. The connection mechanism 43 realizes the bi-directional transfer of the carriage 29 not only between the first and second driving apparatuses 33, 34 but also between the adjacent second driving apparatuses 34, 34. The connection mechanism 43 is separately incorporated in each of the second transporting rail units 28, 28.

Figure 25:
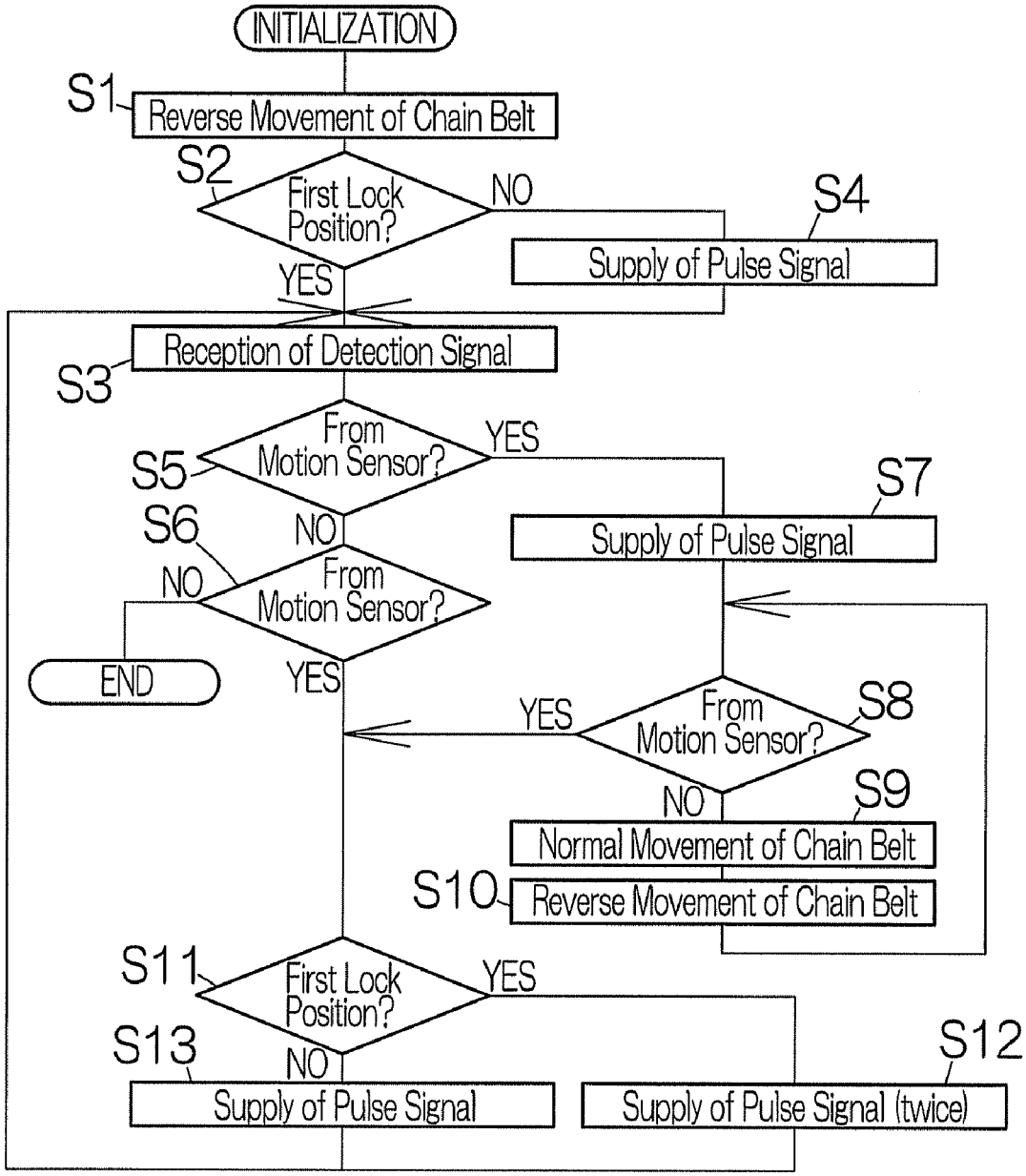
FIG. 25 is a flowchart schematically showing the processes of the initialization of the transporting mechanism unit.

Next, a brief description will be made on the initialization of the transporting mechanism unit 26. The carriage 29 is positioned at a home position on the first rail 31 for the initialization. As shown in the flowchart of FIG. 25, the controller 25 instructs the first and second driving apparatuses 33, 34 to drive the chain belts 37 in the reverse direction in the main cabinet 12 as well as the first to third extension cabinets 13*a*-13*c* at step S1. This results in the carriage 29 moving toward the home position from anywhere on the first and second rails 31, 32, 32.

The controller 25 detects the position of the lock member 53 in the connection mechanism 43 at step S2. A position sensor may previously be connected to the electromagnetic solenoid 54 in the individual connection mechanism 43, for example. The position sensor may be designed to discriminate the lock member 53 at the first lock position and the lock member 53 at the second lock position. If the lock member 53 is detected at the first lock position at step S2, the processing of the controller 25 advances to step S3. When the lock member 53 is detected at the second lock position at step S2, the controller 25 supplies a pulse signal to the electromagnetic solenoid 54 at step S4. The supply of the pulse signal triggers the forward movement of the stem 54*a* in the corresponding electromagnetic solenoid 54. This results in the shift of the lock member 53 to the first lock position. The lock member 53 holds the first arm 46*a* on the restricting piece 51*a* in the link mechanism 44*a*. The first arm 46*b* is released from the restriction of the lock member 53 in the link mechanism 44*b*.

After the lock member 53 has been located at the first lock position, the controller 25 keep standing by until it receives a detection signal. Here, the detection signal is supplied from a predetermined detection sensor to the controller 25 when the carriage 29 reaches the home position. Otherwise, the controller 25 is allowed to receive the detection signal from the motion sensor 55*a*, 55*b*.

When the controller 25 receives a detection signal at step S3, the controller 25 specifies the source of the detection signal. The controller 25 determines at step S5 whether or not the detection signal is supplied from the detection sensor 55*b*. The controller 25 determines at step S6 whether or not the detection signal is supplied from the detection sensor 55*a*. The controller 25 receives the detection signal from the predetermined detection sensor for confirmation of the carriage 29 at the home position. In other words, the processing of the controller 25 ends up subsequent to the decisions at steps S5, S6. The initialization is in this manner completed.

If the controller 25 receives the detection signal from the detection sensor 55*b*, the controller 25 supplies a pulse signal to the electromagnetic solenoid 54 at step S7. The electromagnetic solenoid 54 withdraws the stem 54*a* inside in response to the supply of the pulse signal. The lock member 53 is thus allowed to shift to the second lock position. The lock member 53 holds the first arm 46*b* on the restricting piece 51*b* in the link mechanism 44*b*. The first arm 46*a* is released from the restriction of the lock member 53 in the link mechanism 44*a*.

The first or second driving apparatus 33, 34 drives the chain belt 37 in the reverse direction as described above. The motion sensor 55*b* should thus be the first to supply the detection signal when the carriage 29 is transferred from the second rail 32 to the adjacent second rail 32 or from the second rail 32 to the first rail 31 during the movement to the home position. The lock member 53 at the second lock position in the corresponding connection mechanism 43 allows the carriage 29 to move from the second rail 32 to the second rail 32, or from the second rail 32 to the first rail 31, as is apparent from FIGS. 17 and 23. If the lock member 53 is held at the first lock position, the carriage 29 cannot be transferred from the second rail 32 to the second rail 32 or from the second rail 32 to the first rail 31.

The controller 25 observes whether or not the detection signal is received from the motion sensor 55*a* within a predetermined period at step S8. If not received, the controller25 serves to invert the movement of the chain belts 37 at step S9. The first and second driving apparatuses 33, 34 thus drive the chain belts 37 in the normal direction. The controller 25 serves to again invert the movement of the chain belts 37 at step S10. The first and second driving apparatuses 33, 34 thus drive the chain belts 37 in the reverse direction once again. When the carriage 29 is transferred from the second rail 32 to the adjacent second rail 32 or from the second rail 32 to the first rail 31 during the movement to the home position, the carriage 29 is supposed to pass by both the motion sensors 55*b*, 55*a* within the predetermined period. In case where the controller 25 receives no detection signal from the motion sensor55*a* within the predetermined period after the controller 25 has received the detection signal from the motion sensor 55*b*, the carriage 29 is supposed to fail in engagement with the chain belt 37 of the adjacent driving apparatus 33 or 34. The controller 25 is programmed to continually reciprocate the carriage 29 back and forth relative to the chain belt 37 until such a failure is eliminated. When the carriage 29 afterward correctly engages with the chain belt 37, the carriage 29 is allowed to pass by the motion sensor 55*a*. The processing of the controller 25 advances to step S11 after the controller 25 confirms the reception of the detection signal from the motion sensor 55*a* at step S8.

The controller 25 detects the position of the lock member 53 in the connection mechanism 43 at step S11. If the lock member 53 is detected at the first lock position at step S11, the controller 25 supplies a pulse signal twice to the electromagnetic solenoid 54 at step S12. The electromagnetic solenoid 54 thus first drives the stem 54*a* backward then forward in response to the supply of the pulse signals. This movement of the stem 54*a* makes the lock member 53 reciprocate once between the first and second lock positions. The lock member 53 is then held at the first lock position. On the other hand, if the lock member 53 is detected at the second lock position at step S11, the controller 25 supplies a pulse signal to the electromagnetic solenoid 54 at step S13. The lock member 53 thus shifts to the first lock position from the second lock position. The processing of the controller 25 then returns to step S3. The controller 25 stands by until it receives the next detection signal.

When the carriage 29 continuously passes by the motion sensors 55*b*, 55*a* as described above, the lock member 53 is set at the second lock position. Accordingly, the processing of the controller 25 advances to step S13 from step S11. This brings the lock member 53 to the first lock position. When the carriage 29 subsequently reaches the home position, the processing of the controller 25 ends up subsequent to the decisions at steps S5, S6. If the carriage 29 approaches another one of the connection mechanisms 43, the aforementioned processings are carried out again.

Now, assume that the carriage 29 is located in a space between the motion sensors 55*b*, 55*a* at the beginning of the initialization. The first and second arms 46*a*, 47*a* take the second bending attitude in the link mechanism 44*a*. The first arm 46*a* gets distanced from the restricting piece 51*a* around the support shaft 49*a*. If the lock member 53 is shifted to the first lock position at steps S2 and S4, the lock member 53 gets into a space between the first arm 46*a* and the restricting piece 51*a*. When the motion sensor 55*a* supplies a detection signal to the controller 25, the position of the lock member 53 is detected at step S11 subsequent to steps S5 and S6. Here, since the first lock member 53 is detected at the first lock position at step S11, the controller 25 supplies a pulse signal twice to the electromagnetic solenoid 54 at step S12. The electromagnetic solenoid 54 pulls back the stem 54*a* to the retreat position in response to the supply of the first pulse signal. This movement makes the lock member 53 shift from the first lock position to the second lock position. The lock member 53 is thus allowed to retreat from the space between the first arm 46*a* and the restricting piece 51*a*. The first arm 46*a* is urged against the restricting piece 51*a* based on the elastic repulsive force of the second elastic member 52. When the second pulse signal is supplied to the electromagnetic solenoid 54, the lock member 53 is allowed to shift to the first lock position. The lock member 53 holds the first arm 46*a* on the restricting piece 51*a*.

The first and second rails 31, 32 of the aforementioned embodiment function as a support member of the present invention. Alternatively, a support member of the present invention may be separate from the first and second rails 31, 32. In this case, the support member may be fixed to the first and second rails 31, 32. In addition, electric power may be supplied to the first and second driving apparatuses 33, 34 as well as the motion sensor 55*a*, 55*b* from the main cabinet 12 and the first to third extension cabinets 13*a*-13*c*, for example. The first and second transporting rail units 27, 28 may include wires established between the controller 25 and the individual motion sensors 55*a*, 55*b* as well as between the controller 25 and the first and second driving apparatuses 33, 34, respectively. A connector may be employed to connect the wires between the first and second transporting rail units 27, 28 as well as between the adjacent second transporting rail units 28, 28.

What is claimed is:

1. A transporting rail unit comprising:

a rail guiding movement of an object; and a pair of link mechanisms respectively having first and second arms coupled to each other through a connecting pin, the first and second arms taking first and second bending attitudes, the first bending attitude establishing a first angle between the first and second arms around the connecting pin, the second bending attitude establishing a second angle larger than the first angle between the first and second arms around the connecting pin, a first joint between the first and second arms in one of the link mechanisms being opposed to a second joint between the first and second arms in other of the link mechanisms, wherein the link mechanisms each comprises:

a first elastic member exhibiting an elasticity sufficient to distance the first and second arms from each other through a swinging movement around the connecting pin from the first angle to the second angle;

a shaft member coupling the first arm to the rail for relative rotation around a rotation axis set in parallel with an axis of the connecting pin at a location spaced from the connecting pin by a first distance;

a contact member configured to establish a point of action for receiving a force from the object, the point of action being distanced from the connecting pin by a second distance larger than the first distance;

a restricting piece holding the first arm at a specific angular position around the rotation axis when the force acts on the point of action from a first location, the first location set outside first and second imaginary planes, the first arm located inside the first imaginary plane including an axis of the connecting pin and the point of action, the first and second arms located inside the second imaginary plane including the rotation axis and the point of action;

a second elastic member allowing accumulation of an elastic repulsive force based on the relative rotation of the first arm around the rotation axis from the specific angular position when the force acts on the point of action from a second location set outside the first imaginary plane and inside the second imaginary plane; and a lock member holding the first arm at the specific angular position around the rotation axis when the force acts on the point of action from a third location set outside the first imaginary plane and inside the second imaginary plane, wherein the transporting rail unit further comprises a controlling mechanism connected to the lock member, the controlling mechanism configured to allow release of the first arm from the lock member in one of the link mechanism while the lock member holds the first arm at the specific angular position in other of the link mechanism.

2. The transporting rail unit according to claim 1, wherein the contact member comprises a roller configured to rotate around a further rotation axis extending through the point of action in parallel with the connecting pin.

3. A connection mechanism for a transporting mechanism unit, comprising:

a pair of link mechanisms respectively having first and second arms coupled to each other through a connecting pin, the first and second arms taking first and second bending attitudes, the first bending attitude establishing a first angle between the first and second arms around the connecting pin, the second bending attitude establishing a second angle larger than the first angle between the first and second arms around the connecting pin, a first joint between the first and second arms in one of the link mechanisms being opposed to a second joint between the first and second arms in other of the link mechanisms, wherein the link mechanisms each comprises:

a first elastic member exhibiting an elasticity sufficient to distance the first and second arms from each other through a swinging movement around the connecting pin from the first angle to the second angle;

a support member distanced from the connecting pin by a first distance, the support member supporting the first arm for relative rotation around a rotation axis set in parallel with an axis of the connecting pin;

a contact member configured to establish a point of action for receiving a force from the object, the point of action being distanced from the connecting pin by a second distance larger than the first distance;

a restricting piece holding the first arm at a specific angular position around the rotation axis when the force acts on the point of action from a first location, the first location set outside first and second imaginary planes, the first arm located inside the first imaginary plane including an axis of the connecting pin and the point of action, the first and second arms located inside the second imaginary plane including the rotation axis and the point of action;

a second elastic member allowing accumulation of an elastic repulsive force based on the relative rotation of the first arm around the rotation axis from the specific angular position when the force acts on the point of action from a second location set outside the first imaginary plane and inside the second imaginary plane; and a lock member holding the first arm at the specific angular position around the rotation axis when the force acts on the point of action from a third location set outside the first imaginary plane and inside the second imaginary plane, wherein the transporting rail unit further comprises a controlling mechanism connected to the lock member, the controlling mechanism configured to allow release of the first arm from the lock member in one of the link mechanism while the lock member holds the first arm at the specific angular position in other of the link mechanism.

4. The connection mechanism according to claim 3, wherein the contact member comprises a roller configured to rotate around a further rotation axis extending through the point of action in parallel with the connecting pin.

* * * * *